US011310884B2

(12) United States Patent
Pearse

(10) Patent No.: US 11,310,884 B2
(45) Date of Patent: Apr. 19, 2022

(54) LED LUMINAIRE AND ENGINE SYSTEMS

(71) Applicant: KING LUMINAIRE COMPANY, INC., Jefferson, OH (US)

(72) Inventor: Michael R. Pearse, Fergus (CA)

(73) Assignee: KING LUMINAIRE COMPANY, INC., Jefferson, OH (US)

( * ) Notice: Subject to any disclaimer, the term of this patent is extended or adjusted under 35 U.S.C. 154(b) by 294 days.

(21) Appl. No.: 16/555,519

(22) Filed: Aug. 29, 2019

(65) Prior Publication Data

US 2020/0383181 A1 Dec. 3, 2020

Related U.S. Application Data

(60) Provisional application No. 62/853,467, filed on May 28, 2019.

(51) Int. Cl.

| | |
|---|---|
| ***H05B 45/50*** | (2020.01) |
| ***F21K 9/65*** | (2016.01) |
| ***F21K 9/238*** | (2016.01) |
| ***F21K 9/237*** | (2016.01) |

(52) U.S. Cl.

CPC ..... *H05B 45/50* (2020.01); *F21K 9/237* (2016.08); *F21K 9/238* (2016.08); *F21K 9/65* (2016.08)

(58) Field of Classification Search

CPC ..... H05B 45/00; H05B 45/10; H05B 45/50; F21K 9/237; F21K 9/238; F21K 9/65

See application file for complete search history.

(56) References Cited

U.S. PATENT DOCUMENTS

| | | | | |
|---|---|---|---|---|
| 5,990,802 | A | 11/1999 | Maskeny | |
| 6,331,063 | B1 | 12/2001 | Kamada et al. | |
| 6,462,669 | B1 | 10/2002 | Pederson | |
| 7,824,068 | B2 | 11/2010 | Wulfinghoff | |
| 7,857,497 | B2 | 12/2010 | Koike et al. | |
| 7,988,335 | B2 | 8/2011 | Lui et al. | |
| 8,047,682 | B2 | 11/2011 | Zheng et al. | |
| 8,342,709 | B2 | 1/2013 | Lueken et al. | |
| 8,531,134 | B2 | 9/2013 | Chemel et al. | |
| 9,447,948 | B2 | 9/2016 | Wang et al. | |
| 9,685,102 | B1 | 6/2017 | Auyeung et al. | |
| 9,791,116 | B2 | 10/2017 | Mrakovich et al. | |
| 9,845,939 | B2 | 12/2017 | Kim | |
| 2010/0296285 | A1 | 11/2010 | Chemel et al. | |
| 2012/0274208 | A1* | 11/2012 | Chen | H01Q 1/52 315/34 |
| 2016/0215932 | A1* | 7/2016 | Myers | F21V 23/003 |
| 2018/0320846 | A1 | 11/2018 | Sozzi et al. | |

FOREIGN PATENT DOCUMENTS

| | | | |
|---|---|---|---|
| CN | 204066638 | U | 12/2014 |

* cited by examiner

*Primary Examiner* — Jimmy T Vu

(74) *Attorney, Agent, or Firm* — Vorys, Sater, Seymour and Pease LLP; William E. Ryan

(57) ABSTRACT

An LED luminaire includes an LED engine system that drives a plurality of interchangeable LED modules. The LED engine system may be arranged in a luminaire housing. The LED engine system includes a power plate assembly and a plurality of LED modules that are removable and interchangeable with respect to the power plate assembly. The LED engine system is customizable or modifiable to vary the light output therefrom, in that various types of LED modules may be utilizable therewith and one or more of the LED modules may be mounted to the power plate assembly at two or more orientations.

20 Claims, 13 Drawing Sheets

LED LUMINAIRE AND ENGINE SYSTEMS

CROSS-REFERENCE TO RELATED APPLICATION

This application claims priority to and the benefit of pending U.S. Provisional Application No. 62/853,467 filed May 28, 2019, which is incorporated by reference herein in its entirety.

BACKGROUND

A luminaire generally refers to a complete lighting unit consisting of a lamp or lamps (i.e., light source) together with the parts designed to distribute the light emitted from the lamp(s), the parts designed to position and protect the lamp(s), and the parts designed to connect the lamps to the power supply. Conventional luminaires may thus include a housing within which the lamp(s) and associated secondary lenses, reflectors, refractors, circuitry and electrical connection, etc., are contained. In use, these conventional luminaires may be mounted and suspended via a bracket or pole, for example, to illuminate a space such as a street or roadway.

It is known that light emitting diode ("LED") light sources are more efficient than conventional light sources, which include incandescent light bulbs, fluorescent light bulbs, halogen light bulbs, metal halide light bulbs, etc. Therefore, luminaires incorporating lamps with LED technology as a light source (individually, an "LED luminaire") have been developed for efficient lighting. As compared to luminaires utilizing conventional lamps or light sources, LED luminaires are more efficient in that they produce more light (as measured in Lumens) per watt ("W"), have significantly longer lifespans, and require less maintenance and replacement. However, currently available LED luminaires are disadvantageous in that they are difficult to adjust or modify various lighting characteristics. For example, it is difficult to adjust or modify currently available LED luminaires in terms of their outputted light distribution patterns, light intensity, light correlated color temperature ("CTT"), and light wavelength. Accordingly, a need exists for an LED engine system that simplifies modification and adjustment of lighting characteristics of LED luminaires.

SUMMARY

Embodiments of the present disclosure are generally directed to an LED engine system, comprising: a power plate assembly having a plate, a frame secured on a front face of the plate, and a power distribution circuit arranged on a rear face of the plate, wherein the power distribution circuit is configured to distribute electricity to a plurality of mounting locations defined by the frame on the front face of the plate; and one or more LED modules attachable within the plurality of mounting locations, wherein the one or more LED modules are configured to be mounted within the mounting locations when oriented in at least two positions.

In some examples, the LED engine system further comprises a driver for supplying power to the power distribution circuit, wherein the driver is configured to maintain constant output voltage from the power distribution circuit regardless of how many of the one or more LED modules are mounted to the power plate assembly.

In some examples, the power distribution circuit includes a plurality of parallel sub-circuits that each correspond with one of the mounting locations. In some of these examples, each of the plurality of parallel sub-circuits of the power distribution circuit are arranged on the rear face of the plate at locations associated with one of the mounting locations on the front face of the plate. In addition or instead, in some of these examples the LED engine system may further comprise a driver for supplying power to the power distribution circuit such that each of the plurality of parallel sub-circuits thereof maintains constant output voltage regardless of whether an associated one of the one or more LED modules has been removed from the mounting location corresponding with the parallel sub-circuit.

In some examples, the power plate assembly further includes a plurality of electrical coupling pairs arranged within the plate and in communication with the power distribution circuit, wherein at least two of the electrical coupling pairs are provided within each of the mounting locations. In some of these examples, the one or more LED modules each further comprising a pair of power pins configured to communicate with the electrical coupling pairs. In some of these latter examples, the pair of power pins of each of the one or more LED modules is arranged asymmetric relative to a perpendicular reference plane of the LED module, and wherein each mounting location includes a first pair of electrical couplings and a second pair of electrical couplings that are arranged symmetrical relative to a perpendicular reference plane of the mounting location.

In some examples, the one or more LED modules may be mounted within the mounting locations when oriented in a first position or when oriented in a second position, the first position being defined as a position of the LED module where a reference plane of the LED module that is perpendicular of the front face of the plate is parallel to a reference plane of the plate, and the second position being defined as a position of the LED module after the LED module has been rotated 180 degrees from the first position such that the reference plane of the LED module is parallel to the reference plane of the plate. In some of these examples, the one or more LED modules each include a pair of power pins arranged asymmetric relative to the reference plane of the LED module. In addition or instead, in some of these examples the power plate assembly may further include a plurality of electrical couplings arranged within the plate and in communication with the power distribution circuit, wherein at least two pairs of the electrical couplings are arranged within each of the mounting locations.

Embodiments of the present disclosure are also generally directed to an LED engine system, comprising: a power plate assembly having a plate, a frame secured on a front face of the plate, and a power distribution circuit arranged on a rear face of the plate, wherein the power distribution circuit is configured to distribute electricity in parallel to a plurality of mounting locations defined by the frame on the front face of the plate; a driver for supplying power to the power distribution circuit; and one or more LED modules attachable within the plurality of mounting locations, wherein the one or more LED modules are configured to be mounted within the mounting locations when oriented in at least two positions.

In some examples, the power distribution circuit includes a plurality of parallel sub-circuits that each correspond with one of the mounting locations. In some of these examples, each of the plurality of parallel sub-circuits of the power distribution circuit may be arranged on the rear face of the plate at locations associated with one of the mounting locations on the front face of the plate. In addition or instead, in some of these examples the driver may be a constant voltage driver configured to maintain constant output voltage of each of the plurality of parallel sub-circuits of the power distribution circuit regardless of whether the plurality of parallel sub-circuits of the power distribution are loaded.

In some examples, the LED engine system of claim 12, the power plate assembly further includes a plurality of electrical coupling pairs arranged within the plate and in communication with the power distribution circuit, wherein at least two of the electrical coupling pairs are provided within each of the mounting locations. In some of these examples, the one or more LED modules each further comprising a pair of power pins configured to communicate with the electrical coupling pairs; and in some of these latter examples, the pair of power pins of each of the one or more LED modules may be arranged asymmetric relative to a perpendicular reference plane of the LED module, and wherein each mounting location includes a first pair of electrical couplings and a second pair of electrical couplings that are arranged symmetrical relative to a perpendicular reference plane of the mounting location.

Embodiments of the present disclosure are also generally directed to an LED engine system, comprising: a power plate assembly having a plate, a power distribution circuit arranged on a rear face of the plate and having a plurality of parallel circuits, a plurality of electrical coupling pairs arranged within the plate and in communication with the power distribution circuit, and a frame secured on a front face of the plate and defining a plurality of mounting locations, wherein at least two of the electrical coupling pairs are associated with each of the mounting locations and the power distribution circuit is configured to distribute electricity to the at least two electrical coupling pairs of each mounting location in parallel; a constant voltage driver for supplying power to the power distribution circuit; and one or more LED modules attachable within the plurality of mounting locations, each of the LED modules includes a pair of asymmetrical power pins configured to mate with the electrical coupling pairs when the LED module is oriented in one of at least two positions. In some of these examples, the pair of asymmetrical power pins of each of the one or more LED modules are off-set from a perpendicular reference plane of the LED module, and wherein each mounting location includes a first pair of electrical couplings and a second pair of electrical couplings that are arranged symmetrical relative to a perpendicular reference plane of the mounting location.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to LED technology and, more particularly, to LED engine systems utilizable in luminaires and other fixtures to enhance and simplify modification of lighting characteristics in commercial and residential lighting applications.

The embodiments described herein provide an LED engine system with interchangeable LED modules. Other embodiments described herein provide a luminaire having a luminaire housing in which the LED engine system may be arranged.

Figure 1:
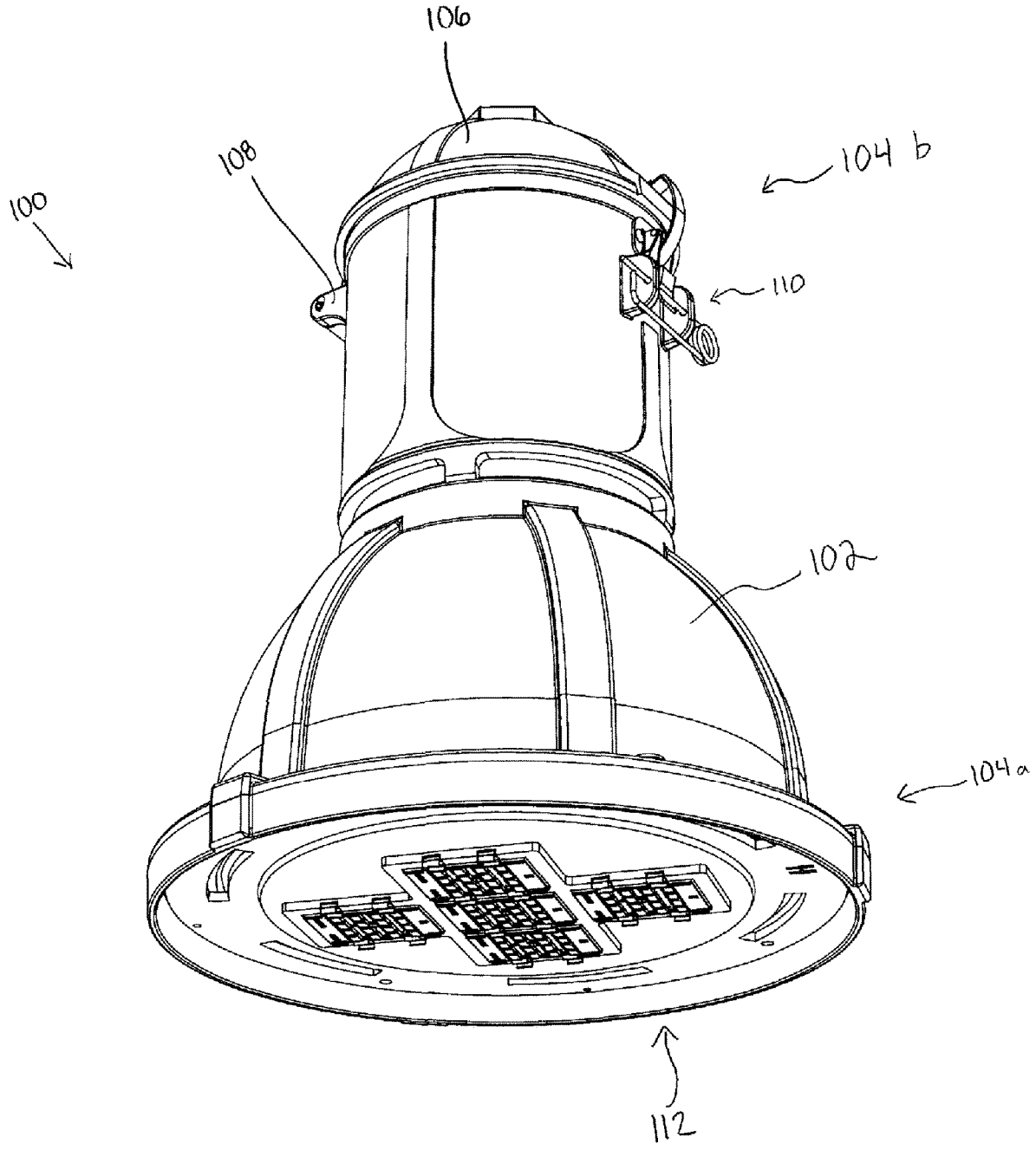
FIG. 1 is an isometric view of an example LED luminaire that may incorporate the principles of the present disclosure.

FIG. 1 is an isometric view of an example LED luminaire 100 that may incorporate the principles of the present disclosure. The depicted LED luminaire 100 is just one example LED luminaire that can suitably incorporate the principles of the present disclosure. Indeed, many alternative designs and configurations of the LED luminaire 100 may be employed, without departing from the scope of this disclosure.

As illustrated, the LED luminaire 100 includes a luminaire housing 102 having a distal end 104*a* and a proximal end 104*b*. The luminaire housing 102 may be configured to be attached to a support structure (e.g., a pole) for suspending or positioning the LED luminaire 100 within its ultimate end-use environment. In the illustrated example, the luminaire housing 102 is configured as a pendant style mounted luminaire housing such that the LED luminaire 100 may be utilized in street or roadway illumination applications. It will be appreciated, however, that the luminaire housing 102 may have various other configurations without departing from the present disclosure. In addition, the luminaire housing 102 may be made of any rigid or semi-rigid material, such as a metal or a plastic.

The proximal end 104*b* of the luminaire housing 102 may be configured to permit access to an internal cavity or space (see FIG. 2) defined by the luminaire housing 102. Accordingly, personnel installing, maintaining, or otherwise utilizing the LED luminaire 100 may access the internal cavity (see FIG. 2) of the luminaire housing 102 for installation, maintenance, or other purposes as may be desirable during the life span of the LED luminaire 100. In the illustrated example, a cap or lid 106 is provided over an opening (see FIG. 2) defined at the proximal end 104*b* of the luminaire housing 102. In some examples, one or more gasket or seal elements (not illustrated) are provided to ensure a sealed closure of the cap 106 relative to the luminaire housing 102.

The cap 106 is configured to be at least partially removable relative to the luminaire housing 102. In this manner, access to the internal cavity (see FIG. 2) of the luminaire housing 102 is permitted when desirable, while also permitting complete closure of the cap 106 over the opening (see FIG. 2) at the proximal end 104*b* of the luminaire housing 102 to inhibit ingress of external debris, moisture, or other elements to the internal cavity (see FIG. 2) of the luminaire housing 102. In some examples, a hinge 108 is provided for connecting the cap 106 to the luminaire housing 102 in a manner that permits relative rotation between the cap 106 and the luminaire housing 102. For example, the hinge 108 may couple the cap 106 to the luminaire housing 102 so that the cap 106 may rotate relative to the luminaire housing 102 about an axis of rotation defined by the hinge 108. In these examples, the hinge 108 may provide one degree of freedom, meaning it permits relative rotation about its axis of rotation while inhibiting all other relative translations or rotations between the cap 106 and the luminaire housing 102. However, in other examples, other mechanisms or means may be utilized to secure the cap 106 relative to the luminaire housing 102 in a manner permitting the cap 106 to be at least partially removable relative to the luminaire housing 102. In addition, a means may be provided for locking or securing the cap 106 relative to the luminaire housing 102. Here, a locking assembly 110 is connected to the luminaire housing 102 and configured to lock or secure the lid 106 over the opening (see FIG. 2) at the proximal end 104*b* of the luminaire housing 102 when the lid 106 is in the closed position. As will be appreciated, a user of the LED luminaire 100 may engage the locking assembly 110 to unlatch or unlock the lid 106 from the luminaire housing 102 such that the lid 106 may be rotated away from the luminaire housing 102 and thereby provide access to the opening (see FIG. 2) and the internal cavity (see FIG. 2) of the luminaire housing 102 in communication therewith. It will be appreciated that, while the locking assembly 110 is illustrated as a latch that may be secured with a locking device, various other types of locking assemblies and mechanisms may be utilized to secure the lid 106 to the luminaire housing 102.

The LED luminaire 100 also includes an LED engine system 112. In the illustrated example, the LED engine system 112 is arranged at the distal end 104*a* of the luminaire housing 102. In some examples, the LED engine system 112 is removable from the luminaire housing 102, thereby facilitating customization and modification of the LED luminaire 100. Thus, a retaining means is provided to attach the LED engine system 112 within a corresponding opening or space (see FIG. 2) defined at the distal end 104*a* of the luminaire housing 102.

The retaining means may include various types of mechanical or non-mechanical fastening mechanisms. In some examples, the LED engine system 112 is secured to the luminaire housing 102 via a plurality of fasteners, including but not limited to bolts, clamps, clasps, clips, pins, rivets, screws, etc. In the illustrated example, the LED engine system 112 is secured to the luminaire housing 102 via a plurality of threaded fasteners (i.e., bolts) that extend into and through the LED engine system 112 to retain it to the luminaire housing 102.

Alternate fastening mechanisms may be utilized, however. For example, the LED engine system 112 may be retained within the luminaire housing 102 via a bayonet mount. In these examples, the LED engine system 112 may be configured as the male side of the bayonet mount and the luminaire housing 102 may be configured as the female side of the bayonet mount, and vice versa. The male side of the bayonet mount may include one or more vertical connectors that each have a radial (or horizontal) pin extending therefrom, and the female side of the bayonet mount may include corresponding "L" shaped slots that each comprise a vertical slot segment and a horizontal slot segment extending therefrom with an upwardly extending segment (or serif) at the end of the horizontal slot segment. Here, each pin slides into the vertical slot segment of the corresponding "L" shaped slot, and then rotates across the horizontal slot segment, into the upwardly extending segment.

In other non-illustrated examples, the LED engine system 112 may be retained within the luminaire housing 102 via a threaded collar (not illustrated). In these examples, the distal end 104*a* of the luminaire housing 102 may be configured to receive the threaded collar (not illustrated). Thus, after positioning the LED engine system 112 in the corresponding space (see FIG. 2) defined at the distal end 104*a* of the luminaire housing 102, the threaded collar may be screwed onto the distal end 104*a* of the luminaire housing 102 to secure the LED engine system 112 between the luminaire housing 102 and the threaded collar.

Figure 2:
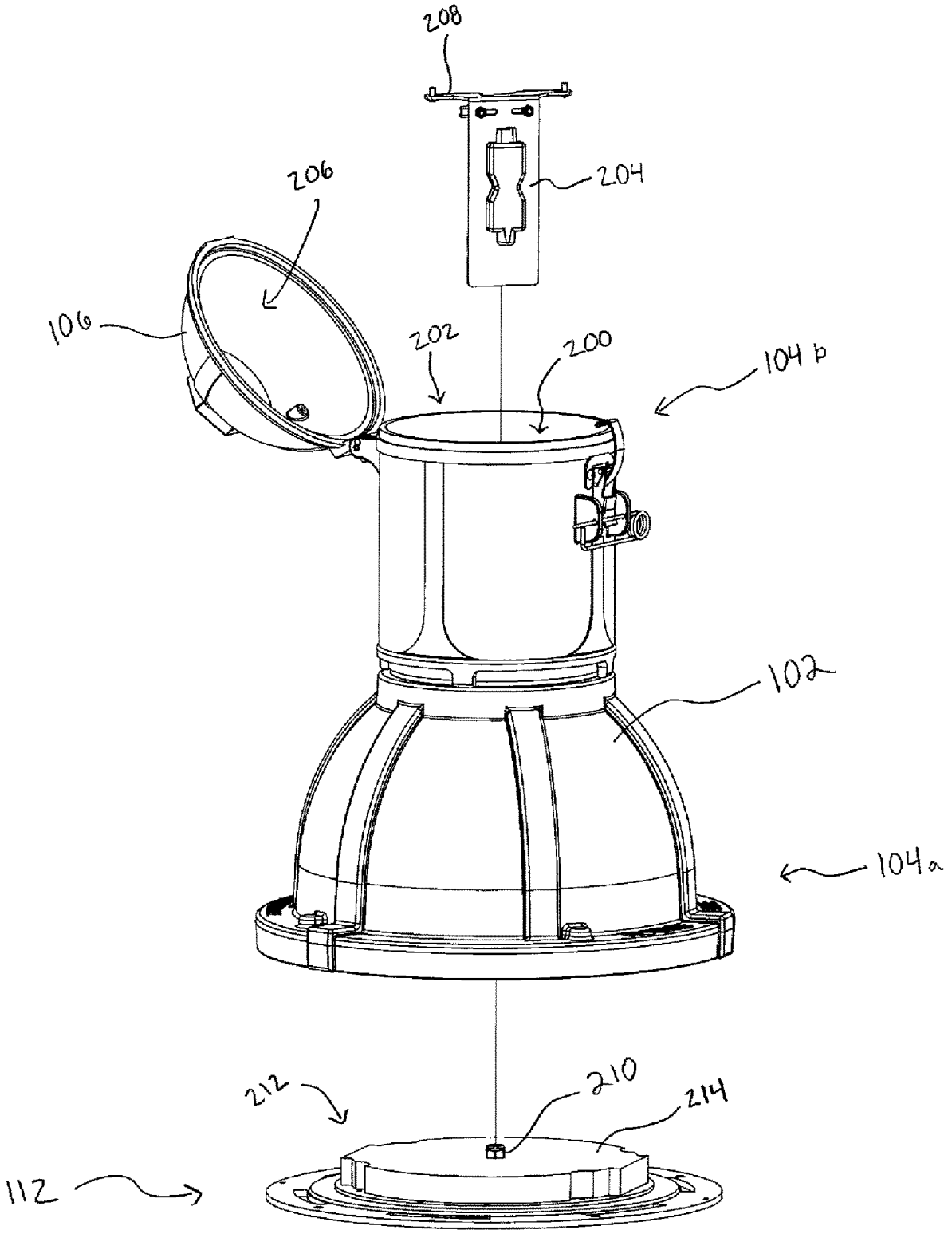
FIG. 2 is an exploded view of the LED luminaire of FIG. 1.

FIG. 2 is an exploded view of the LED luminaire 100 of FIG. 1. In particular, FIG. 2 illustrates the cap 106 having been rotated away from (or off of) the luminaire housing 102 so as to expose an internal cavity 200 defined within the luminaire housing 102 that extends from and is in communication with an opening 202 defined at the proximal end 104*b* of the luminaire housing 102.

As illustrated, the LED luminaire 100 may also include electronic devices arrangeable within the internal cavity 200 for electrically connecting the LED engine system 112 to an external power source (not illustrated) and/or existing infrastructure. For example, the LED luminaire 100 may include an LED driver 204 (also known as a power conditioner, a power supply, etc.) configured to condition voltage and current (received from the external power source and/or existing infrastructure) such that the voltage and current are at levels utilizable by the various downstream electronics and light emitters of the LED engine system 112. In the illustrated example, the LED driver 204 is an internal LED power supply that extends into the internal cavity 200 of the luminaire housing 102 through the opening 202 at the proximal end 104*b* thereof.

The LED driver 204 may rectify higher-voltage alternating current ("AC") received from the external power source into lower-voltage direct current ("DC") that is utilizable by the various electronics and light emitters of the LED engine system 112 described below. The LED driver 204 may also protect the electronics and light emitters of the LED engine system 112 from voltage and/or current fluctuations. For example, a change in voltage could cause a change in the current being supplied to the light emitters (i.e., LEDs). Thus, because LED light output is proportional to its current supply and because LEDs are rated to operate at or within a certain current or range of currents, too much or too little current can cause LED light output to vary or degrade faster due to higher temperatures within the LEDs. Therefore, the LED driver 204 may be configured to convert externally received higher-voltage AC to lower-voltage DC and maintain the voltage and current flowing through the LED engine system 112 at rated levels. In some examples, however, the output DC voltage may not be less than the input AC voltage. Accordingly, the LED driver 204 generally conditions and maintains the output DC voltage to a range that may be best utilized by the specific by the specific LED module load.

In some examples, the LED driver 204 is configured as a constant voltage LED driver. The (constant voltage) LED driver 204 may be utilized in various applications, for example, where the LED engine system 112 utilizes light emitters (or LEDs) that require a fixed voltage with a maximum (or range of) current. In these examples, the (constant voltage) LED driver 204 receives a standard line voltage (e.g., generally ranging from 120-277 alternating current voltage with respect to power typically output from wall outlets in North American homes), switches the alternating current voltage ("VAC") to a direct current voltage ("VDC") for delivery to the LED engine system 112, and maintains the VDC being supplied to the LED engine system 112 at a constant voltage regardless of the current load applied on the LED driver 204. For example, the LED engine system 112 may include multiple removable LED modules (see FIG. 3), such that the current needed to power the LED engine system 112 (i.e., the load) depends on the number of LED modules present (or installed) on the LED engine system 112. Regardless of how many LED modules are assembled on the LED engine system 112, the (constant voltage) LED driver 204 will maintain a constant voltage supply to the LED engine system 112 with a range of current (i.e., up to its maximum current rating) as needed to power the particular number of LED modules provided on the LED engine system 112. Thus, the (constant voltage) LED driver 204 maintains constant voltage in the LED engine system 112 despite fluctuation or variation in load applied to the (constant voltage) LED driver 204 which occurs when LED modules are added to or removed from the LED engine system 112.

In other examples, the LED driver 204 may be configured as a constant current LED driver. The (constant current) LED driver 204 may be utilized in various applications, for example, where the LED engine system 112 utilizes light emitters (or LEDs) that may operate at a range of voltages but with a fixed current. In these examples, the (constant current) LED driver 204 may have one specified output current (rated in amps) and a range of voltages that will vary depending on the wattage rating of the light emitters (or LEDs) of the LED engine system 112. Utilizing the (constant current) LED driver 204 with a higher amp rating will make the light emitters (or LEDs) brighter and maintain them at consistent brightness; however, it may eventually over-drive the light emitters (or LEDs), which in turn may result in reduced life span and premature failure.

The LED driver 204 may be attached to or within an interior space 206 defined within the cap 106. Here, for example, the LED driver 204 is secured within the interior space 206 of the cap 106 via a bracket or frame 208 that is mountable via one or more threaded fasteners. In this manner, the LED driver 204 may rotate out of the internal cavity 200 of the luminaire housing 102 when the cap 106 is rotated away therefrom into the open position. In other examples, however, the LED driver 204 may be attached to the luminaire housing 102 at the opening 202 or within the internal cavity 200, and removable therefrom after rotating the cap 106 into its open position.

As mentioned, the LED driver 204 is configured to connect to an external power source (not illustrated) so as to deliver power received therefrom to the LED engine system 112. Thus, the LED driver 204 may include a power input portion and a power output portion, with the power input portion configured to attach to the external power source and the power output portion configured to connect to the LED engine system 112. In the illustrated example, wired electrical connections (not illustrated) are utilized to connect the power output portion of the LED driver 204 to an input (or electrical coupling) 210 of the LED engine system 112.

FIG. 2 also illustrates the LED engine system 112 unassembled from the distal end 104*a* of the luminaire housing 102, according to one or more embodiments of the present disclosure. In particular, FIG. 2 illustrates a rear side 212 of the LED engine system 112 that is configured to be arranged within the internal cavity 200 of the luminaire housing 102. Here, a cover or housing 214 is arranged on the rear side 212 of the LED engine system 112 and provided to cover or enclose various electrical components as detailed below. Also in this example, the input 210 of the LED engine system 112 is provided on the cover 214 of the LED engine system 112 that is configured to be disposed within the internal cavity 200 of the luminaire housing 102; however, in other examples the input 210 of the LED engine system 112 may be provided elsewhere on or about the LED engine system 210. Moreover, other means may be utilized to electrically connect the LED driver 204 to the LED engine system 112. For example, the power output portion of the LED driver 204 may be an integral plug configured to be physically inserted into the input 210 of the LED engine system 112 which is similarly or correspondingly configured as a mating socket to receive such integral plug of the LED driver 204, and such integral plug may rotate into and out of the input 210 of the LED engine system 112 as the cap 106 is rotated into its closed position and open position, respectively.

Figure 3:
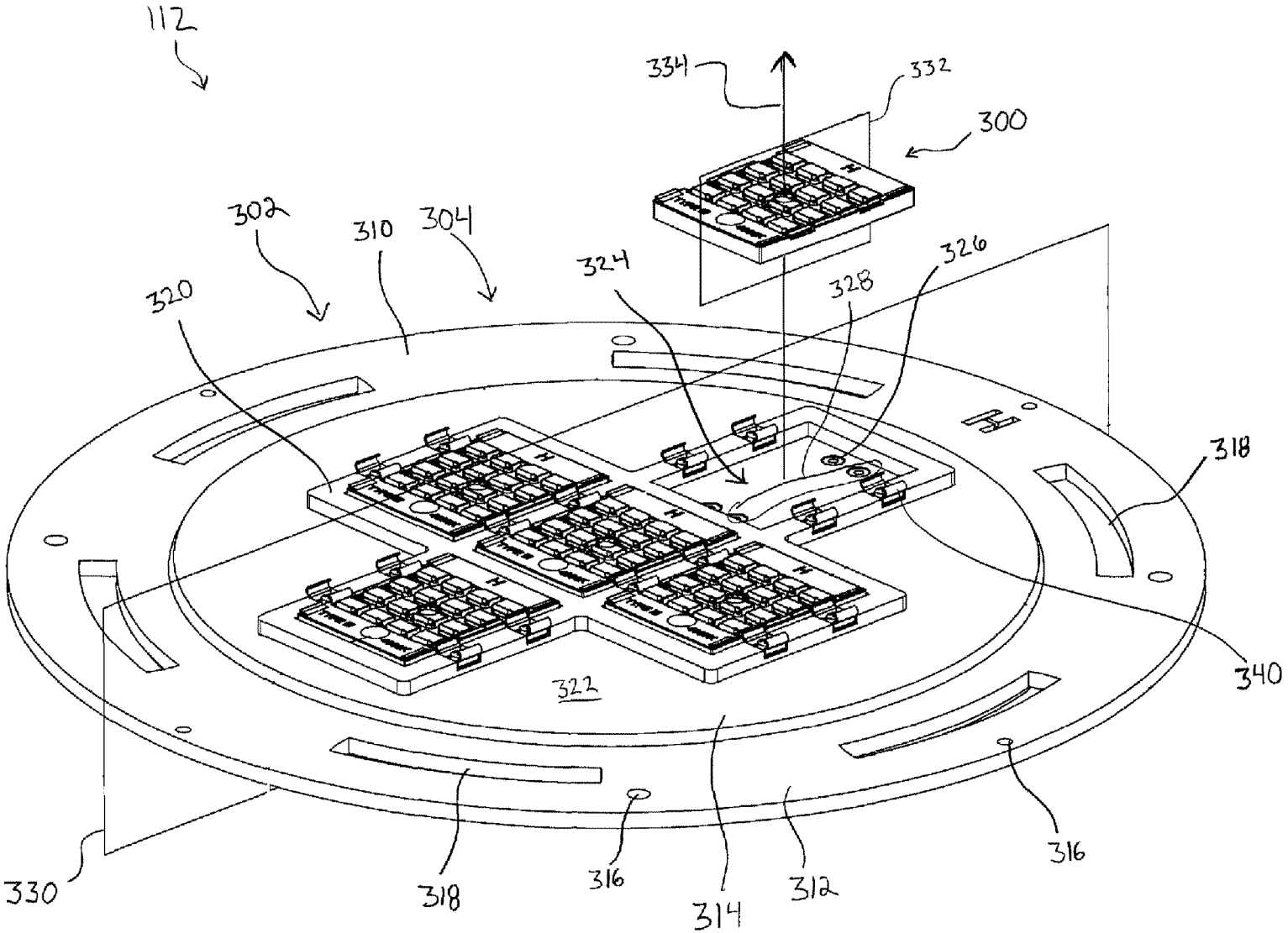
FIG. 3 is an isometric view of an LED engine system that may be utilized with the LED luminaire of FIG. 1.

According to embodiments of the present disclosure, the LED engine system 112 may be incorporated into the luminaire housing 102 at or near the distal end 104*a* thereof. In such embodiments, the LED engine system 112 may operate to emit light that may be modified in terms of distribution patterns, light intensity, light correlated color temperature ("CCT"), and light wavelength. FIG. 3 illustrates the LED engine system 112 of FIGS. 1-2, according to one or more embodiments of the present disclosure.

In particular, FIG. 3 illustrates the LED engine system 112 having a plurality of LED light modules 300 (hereinafter, modules 300) and a power plate assembly 302, according to one or more embodiments of the present disclosure. In this example, the modules 300 may be inserted or installed onto a front side or light emitting side 304 of the power plate assembly 302 that is opposite the rear side 212 of the LED engine system 112 from which the cover 214 extends. Accordingly, lighting characteristics of the LED engine system 112 may be adjusted or modified, or even tailored for a particular end-use application, by changing the type or number of modules 300 present on the power plate assembly 302, and/or changing the orientation at which one or more of the modules 300 is installed on the power plate assembly 302.

As mentioned above, each of the modules 300 may be configured to consume a certain amount of power (in Watts) and to provide or output a certain amount of light intensity (i.e., luminous flux or light flux). The modules 300 may all have the same light intensity characteristics, or one or more of the modules 300 may include one or more different light intensity characteristics; and the end-user may adjust the overall light intensity characteristic of the LED engine system 300 by exchanging one or more of the modules 300 with another module 300 having a different light intensity.

In addition to providing a set amount of light flux per unit (i.e., per each of the modules 300), each of the modules 300 may provide different light distribution patterns by means of using various optical lenses as hereinafter described. As used herein, the term "light distribution" is used to denote various standardized pattern-based distributions of light emitted from a light source in regards to a defined plane such as a street or roadway, and light distribution patterns may take the form of various geometric shapes or other forms based on standards defined by professional institutions such as the Illuminating Engineering Society. The modules 300 may all have the same light distribution characteristics, or one or more of the modules 300 may include one or more different light distribution characteristics; and the end-user may adjust the overall light distribution characteristic of the LED engine system 300 by exchanging one or more of the modules 300 with another module 300 having a different light distribution pattern.

Moreover, each of the modules 300 may provide a different light CCT level by means of using different LED emitters as hereinafter described. As used herein, the term correlated color temperature (or CCT) is a specification of the color appearance of the light emitted by a lamp or light source, relating its color to the color of light from a reference source when heated to a particular temperature, measured in degrees Kelvin (K). The CCT rating for a particular light source is a general "warmth" or "coolness" measure of its appearance. However, opposite to the temperature scale, light sources with a CCT rating below 4,000 K are usually considered "warm" in appearance or "warm sources" (i.e., warm: CCT rating <4,000 K), while those with a CCT above 4,000 K are usually considered "cool" in appearance or "cool sources" (i.e., cool: CCT rating >4,000 K). CCT rating values may generally range from 1,500 K to 10,000 K. The modules 300 may all have the same light CCT characteristics, or one or more of the modules 300 may include one or more different light CCT characteristics; and the end-user may adjust the overall light CCT characteristic of the LED engine system 300 by exchanging one or more of the modules 300 with another module 300 having a different light CCT characteristic.

Even further, each of the modules 300 may be configured to emit light at a certain wavelength or range or wavelengths measured with respect to the electromagnetic spectrum. For example, the modules 300 may emit or radiate light at wavelengths within the visible region of the electromagnetic spectrum when an electrical differential is applied across it (or when a current is passed through it); however, one or more of the modules 300 may emit or radiate light at wavelengths outside of the visible region of the electromagnetic spectrum, and one or more of the modules 300 may both emit or radiate light at wavelengths inside the visible region and emit or radiate light at wavelengths outside the visible region. Thus, the light emitted or radiated by one or more of the modules 300 may include white light, monochromatic light, infrared, ultra-violet, etc. The modules 300 may all emit light at the same wavelength, or one or more of the modules 300 may emit light at one or more different wavelengths; and the end-user may exchange one or more of the modules 300 emitting light at one or more first wavelengths with another module 300 emitting light at one or more second wavelengths.

Thus, various lighting characteristics of the LED engine system 112 may be adjusted or modified via selection of the modules 300 assembled on the power plate assembly 302. However, some lighting characteristics of the LED engine system 112 may be dependent on the physical orientation at which one or more of the modules 300 are mounted on the power plate assembly 302. Accordingly, some lighting characteristics of the LED engine system 112 may be adjusted or modified by adjusting or modifying the physical orientation at which one or more of the modules 300 are mounted on the power plate assembly 302 as described below.

In the illustrated example, the power plate assembly 302 includes a plate 310 and a frame 320. The plate 310 includes a front side and a rear side that correspond with the front side 304 of the power plate assembly 302 and the rear side 212, respectively. As illustrated, the cover 214 extends from the rear side 212 of the plate 310. The plate 310 may be made from various metallic or non-metallic materials that may facilitate thermal transmission, and, in one example, the plate 310 is a cast aluminum plate. Here, the plate 310 includes an exterior region 312, extending along a periphery of the plate 310 and generally defining a diameter of the LED engine system 112, and an interior region 314 surrounded by the exterior region 312 and located within a central portion of the plate 310. The frame 320 may be made from various metallic or non-metallic materials. For example, the frame 320 may be made from various high temperature plastics, or made from various fiber/resin based composites, including without limitation fiberglass or carbon-fiber. In one example, the frame 320 is made from die-cast aluminum.

The exterior region 312 of the plate 310 may be configured for securing the LED engine system 112 to a structure, such as a mounting structure, enclosure, housing, etc. Here, the exterior region 312 is configured for mounting the LED engine system 112 to the luminaire housing 102. Accordingly, the exterior region 312 includes a plurality of mounting holes 316 that correspond with mating mounting holes (not illustrated) arranged about the distal end **104*b* of the luminaire housing 102. The plate 310 may also include one or more vents 318. Here, the vents 318 are circumferentially arranged, about the interior region 313, on the exterior region 312 of the plate 310 to encircle the interior region 314. Various numbers of vents 318 may be utilized to allow cool external, ambient air to flow around the LED engine system 112. For example, the vents 318 may be configured to help create a convective current between the ambient/external environment and the internal cavity 200 of the luminaire housing 102 to cool the rear side 212 of the LED engine system 112 and/or the various components inside the luminaire housing 102. The vents 318 are optional and may or may not be incorporated depending on the thermal characteristics of the ultimate end-use application. Thus, in some examples, the plate 310 may not include any of the vents 318**.

The frame 320 is arranged on the interior region 314 of the plate 310. The interior region 314 may be flush or off-set relative to the exterior region 312 of the plate 310. Here, the interior region 314 of the plate 310 defines a mounting surface 322 on which the frame 320 is mounted, and the mounting surface 322 is off-set such that it is raised relative to (or extends outward from) a neighboring surface of the exterior region 312 of the plate 310 that is proximate thereto. In other examples, the mounting surface 322 of the interior region 314 is flush with the neighboring surface of the exterior region 312 or the mounting surface 322 of the interior region 314 is recessed within the plate 310 relative to the neighboring surface of the exterior region 312.

The frame 320 aligns the modules 300 on the mounting surface 322. As illustrated, the frame 320 includes a plurality of windows or openings that are sized to accommodate the modules 300 and, when arranged on the mounting surface 322 of the plate 310, the windows or openings in the frame 320 define a plurality of mounting locations 324 at which one of the modules 300 may be provided. In FIG. 3, one of the modules 300 is illustrated unassembled from its respective mounting location 324, with four (4) other of the modules 300 mounted within their respective mounting locations 324. The frame 320 may define various arrangements and organizations of mounting locations 324. In the illustrated example, the frame 320 is configured to define a "plus sign" pattern of five (5) mounting locations 324 configured to fit equally sized LED modules. However, the frame 320 may be differently configured. For example, the frame 320 may be configured to define different patterns of mounting locations, to define different numbers of mounting locations, and/or to define mounting locations sized to receive differently sized modules 300. Also, the frame 320 may be configured to define differently sized mounting locations, so that differently sized modules may be utilized therewith.

The power plate assembly 302 includes a plurality of power plate couplings 326 for transmitting power through the plate 310, from the LED driver 204 to the modules 300 that, as described below, comprise conductive portions configured to make electrical contact with the power plate couplings 326. The plurality of power plate electrical couplings 326 (hereinafter, the electrical couplings 326) are arranged on the mounting surface 322 for supplying power to the modules 300. Thus, the electrical couplings 326 electrically couple the modules 300 to the LED engine system 112 and, ultimately, to the LED driver 204. As illustrated, each mounting location 324 may include a plurality of the electrical couplings 326. Here, each of the electrical couplings 326 is configured to receive a power pin of the module 300 inserted in the mounting location 324, such that the power pin of the module 300 makes contact with the internal conducting surface of the electrical coupling 326. As described below, each of the modules 300 may include a pair of power pins, such that each of the mounting locations 324 includes a pair or set 328 of the electrical couplings 326. In some examples, each of the mounting locations 324 includes two (2) or more pairs or sets 328 of the electrical couplings 326, thereby permitting installation of the module 300 at more than one orientation within the mounting location 324.

In the illustrated example, the LED engine system 112 is arranged along a reference plane 330 that symmetrically extends through a center of the power plate assembly 302 so as to divide the LED engine system 112 into a first side and a second side that is symmetrical to the first side. Also illustrated in this example, the module 300 disassembled from the power plate assembly 302 is also arranged along a reference plane 332 that symmetrically extends through a center of the module 300 so as to divide the module 300 into a first side and a second side. Here, the module 300 disassembled from the power plate assembly 302 may be mounted within its respective mounting location 324 by aligning the reference plane 332 of module 300 with the reference plane 330 of the LED engine system 112 and inserting the module 300 into its corresponding mounting location 324.

In the illustrated example, each of the mounting locations 324 includes two pairs or sets 328 of electrical couplings 326. Here, the first pair or set 328 of electrical couplings 326 (comprising a positive and a negative electrode) is off-set to a first side (i.e., right) of the reference plane 330 and arranged to receive the power pins of the module 300 when oriented in a first position (i.e., when the reference planes 330 and 332 are parallel or at zero degrees (0°) relative to each other), and the second pair or set 328 of electrical couplings 326 (comprising a positive and a negative electrode) is off-set to the second side (i.e., left) of the reference plane 330 and arranged to receive the power pins of the module 300 when the module 300 is oriented in a second position (i.e., when the reference planes 330 and 332 are rotated 180°). In other examples, the two (2) pairs or sets 328 of electrical couplings 326 of one or more of the mounting locations 324 may be differently arranged to allow positioning of the modules 300 at different orientations. In other examples, each of the mounting locations 324 may include more than two (2) pairs or sets of the electrical couplings 326, to thereby permit installation of the module 300 within the mounting location 324 at more than two (2) orientations.

The LED engine system 112 may be configured such that the modules 300 are easily removable without any specialized tooling. This will facilitate maintenance and simplify customization of the LED engine system 112. Thus, a securing means for attaching the modules 300 within the mounting locations 324 may be utilized, and such securing means may facilitate insertion and removal of the modules 300 relative to the plate assembly 302. For example, a plurality of springs or snaps 340 may be utilized to mount the modules 300 within their corresponding mounting locations 324. In the illustrated example, springs 340 are arranged about the frame 320 so as to retain opposing sides of each of the modules 330. Here, the springs 340 are pinned about the frame 320; however, in other examples, the springs 340 may be differently connected to the frame 320, for example, the springs 340 may be integrally formed on the frame 320. Also in the illustrated example, each of the springs 340 has a first engagement side and a second engagement side such that each of the springs 340 is configured to engage a first module 300 proximate to the first engagement side and a second module 300 proximate to the second engagement side.

Figure 4:
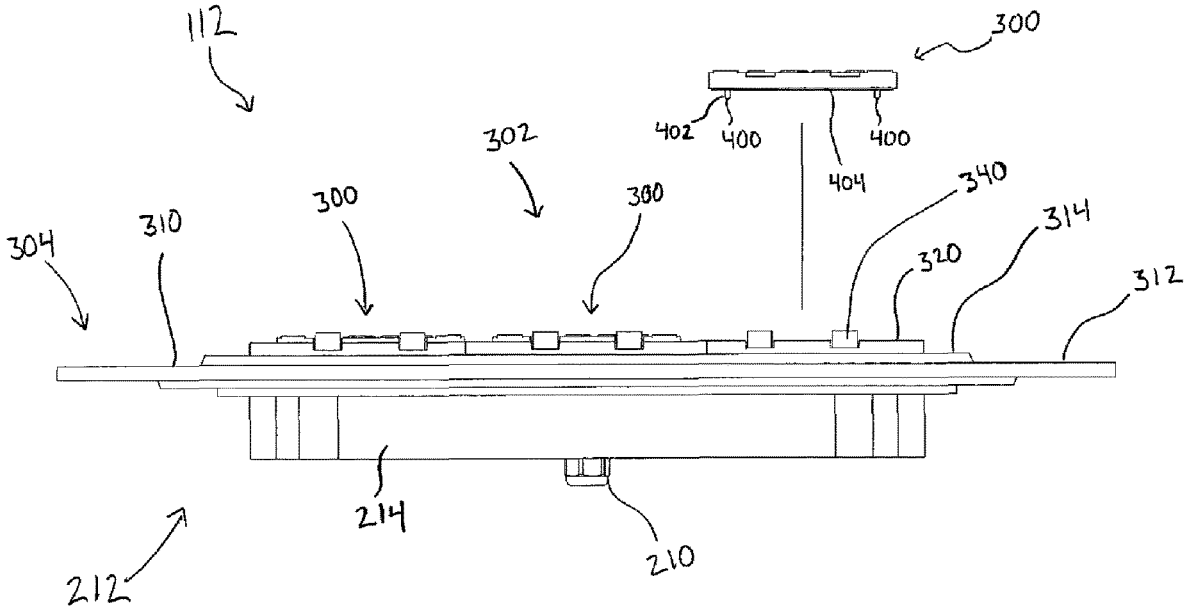
FIG. 4 is a side view of the LED engine system of FIG. 3.
Figure 5:
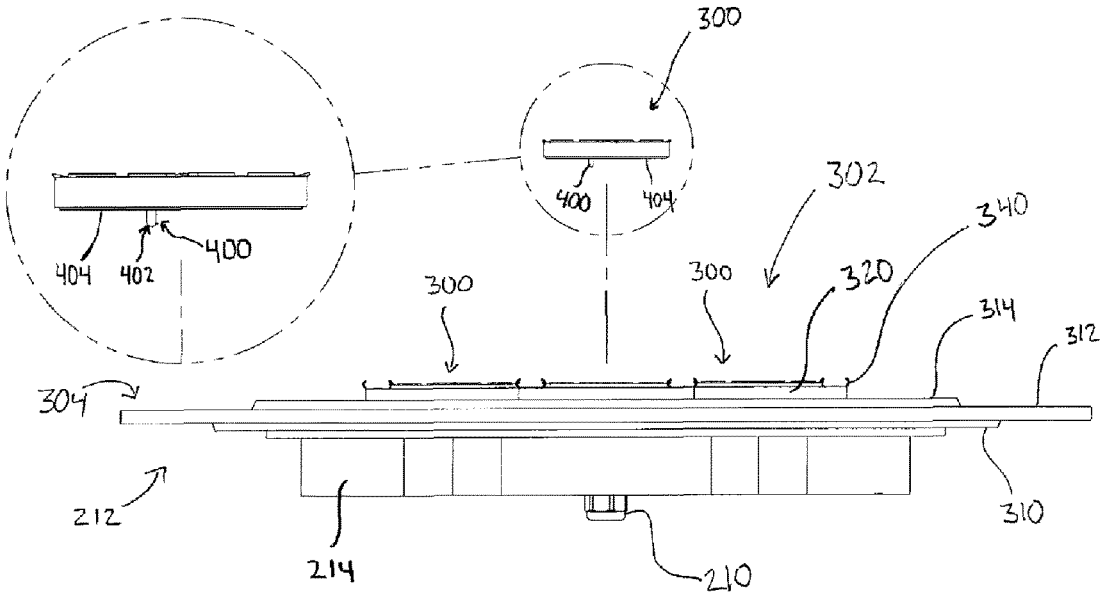
FIG. 5 is a front view of the LED engine system of FIG. 3.

FIG. 4 is a side view of the LED engine system 112 of FIG. 3. In particular, FIG. 4 illustrates the LED engine system 112 when viewed orthogonal to the reference planes 330 and 332 in FIG. 3. FIG. 5 a front view of the LED engine system 112 of FIG. 3. In particular, FIG. 5 illustrates the LED engine system 112 when viewed in line with and parallel to the reference planes 330 and 332 in FIG. 3. Thus, FIG. 5 illustrates a view of the LED engine system 112 of FIG. 4 when rotated ninety degrees (90°).

As with FIG. 3, FIGS. 4-5 illustrate the LED engine system wherein one of the modules 300 is disassembled and spaced away from its respective mounting location 324 on the power plate assembly 302. Here, the module 300 having been disassembled from the power plate assembly 302 is oriented such that the reference plane 332 thereof is parallel with the reference plane 330 of the power plate assembly 302. The reference plane 332 of the particular one of the modules 300 disassembled from the power plate assembly 302 in this example is also co-planar with the reference plane 330 of the power plate assembly 302 due to the location of the mounting location 326; however, not all of the modules 300 when dissembled will have reference planes 332 that are co-planar with the reference plane 330 of the power plate assembly 302, as such modules 300 may be parallel with but off-set to one side or another of the reference plane 330 of the power plate assembly 302. Thus, depending on the arrangement or windows in the frame 320, the reference plane 332 of one or more of the modules 300 may not be co-planar with the reference plane 330 of the power plate assembly 302.

Each of the modules 300 is configured to be electrically coupled to the power plate assembly 302 when installed thereon. As previously mentioned, the modules 300 may have electrodes for receiving power from upstream components. In the illustrated example, each of the modules 300 includes a pair of module power pins 400, with a first of the module power pins 400 comprising a negative electrode (i.e., having negative polarity) and the second of the module power pins 400 comprising a positive electrode (i.e., having positive polarity). Here, the module power pins 400 are PCB pins having a conductive head (see FIGS. 9 and 14) configured to contact a trace on a module circuit board (not illustrated) of the module 300 (see FIGS. 14A-14B and 15A-15D), and a conductive tip extending therefrom. As hereinafter described, the module power pins 400 may be insulated. For example, the module power pin 400 may include a shaft portion (not illustrated), extending from the conductive head through the module circuit board, and a conductive tip 402 extending from the shaft portion of the module power pin 400 and protruding from a bottom surface 404 of the module 300, so as to be exposed as illustrated in FIGS. 4-5. In some examples, an insulated sleeve or pin insulator (see FIG. 14) is arranged around the shaft portion of the module power pin 400 so as to define an insulated shaft portion thereof; whereas, in other examples, the shaft portion of the module power pin 400 includes an insulator integrally arranged thereon, between the conductive head and the conductive tip 402, so as to define an insulated shaft portion. The modules 300 and the various circuitry and electrical components thereof are further described with reference to FIGS. 14A-14B and 15A-15D.

Each of the pair of module power pins 400 is configured to be received within a respective one of the electrical couplings 326 such that the module power pin 400 of the module 300 makes contact with an associated internal conducting surface of the electrical coupling 326 within the power plate assembly 302. As illustrated in FIG. 5, the pair of module power pins 400 may be asymmetrically arranged on the module 300 relative to the reference plane 332. Thus, the pair of module power pins 400 are disposed on one side of the reference plane 332 and positioned on that side of the reference plane 332 in correspondence with the first or second pair or set 328 of electrical couplings 326. Thus, for example, the pair of module power pins 400 may slide into the first pair or set 328 of electrical couplings 326 when the module 300 is oriented in a first position where the reference planes 330 and 332 are parallel and at zero degrees (0°) relative to each other. Also in this example, the pair of module power pins 400 may slide into the second pair or set 328 of electrical couplings 326 when the module 300 is oriented in a second position where the module 300 has been rotated, about a central axis 334 of the module 300, such that the reference planes 330 and 332 are parallel but at 180° relative to each other. In other non-illustrated examples, the power plate assembly 302 may be configured with pairs of electrical couplings 326 arranged at locations to receive the pair of module power pins 400 when the module 300 is rotated into other positions, for example, such as when the reference planes 330 and 332 are oriented at ninety degrees (90°) relative to each other, at two hundred and seventy degrees (270°) relative to each other, etc.

Figure 6:
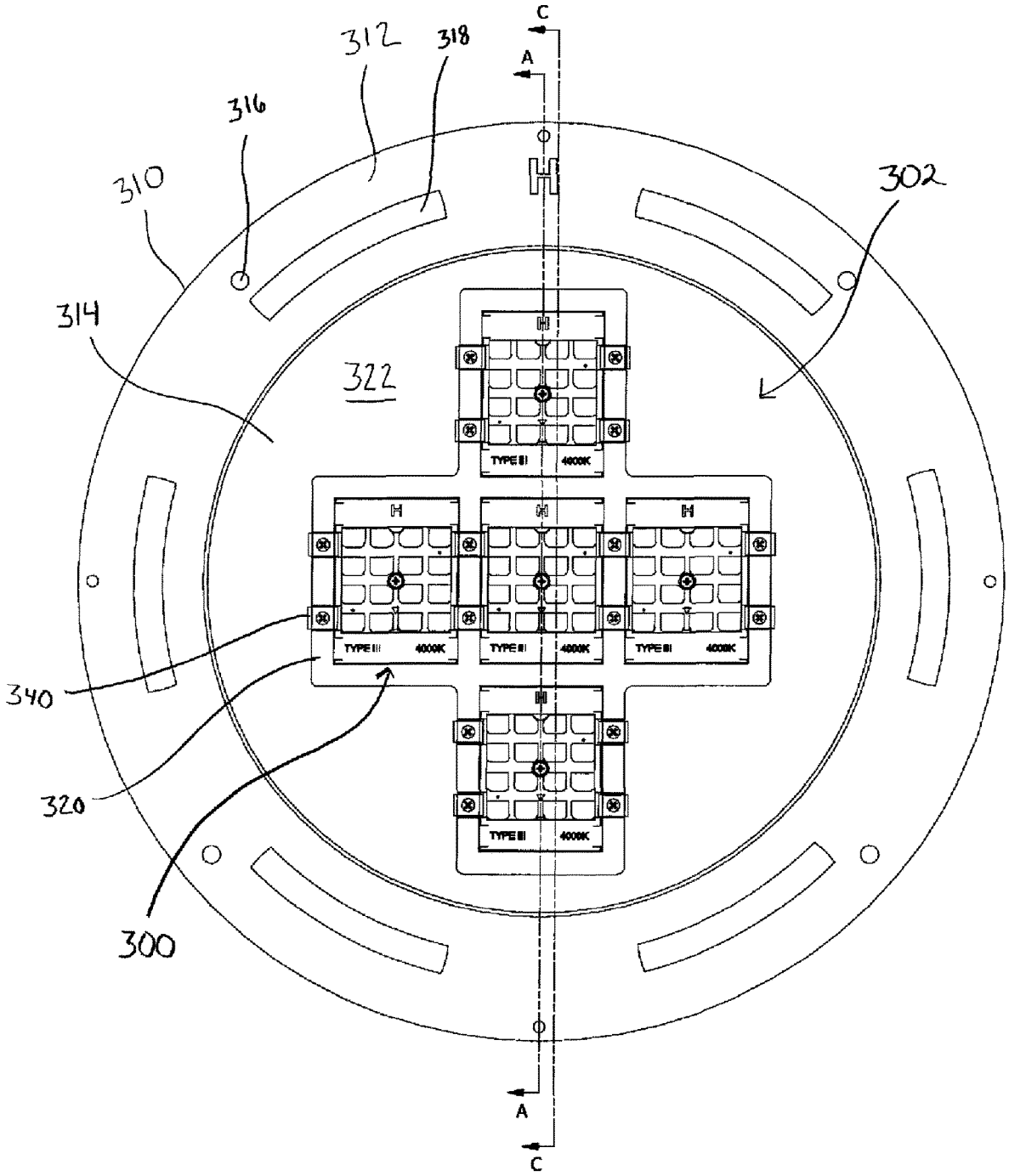
FIG. 6 is a top view of the LED engine system having a plurality of LED modules mounted thereon.
Figure 7:
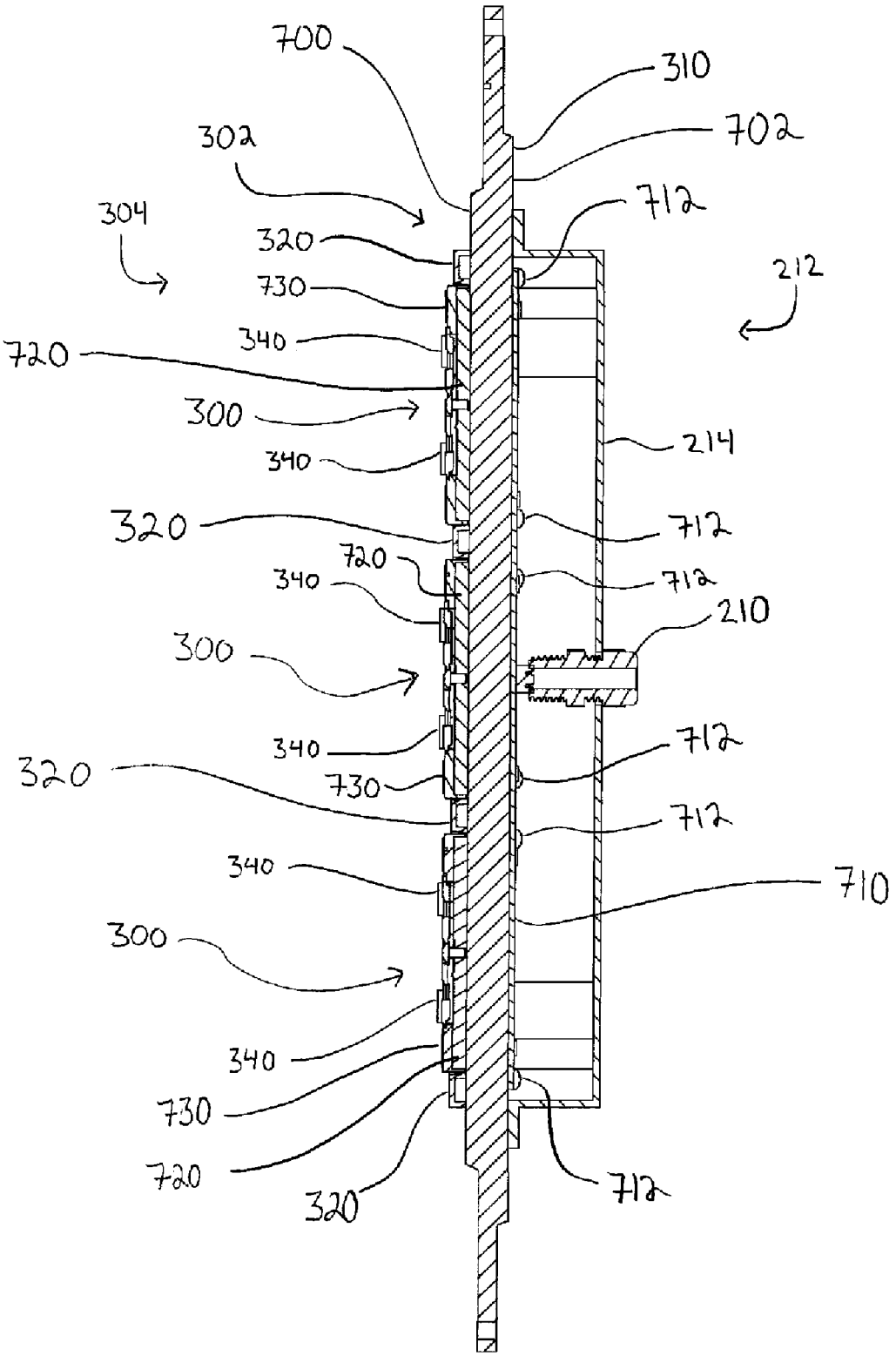
FIG. 7 is a cross-sectional side view of the LED engine system along section line A-A in FIG. 6.
Figure 8:
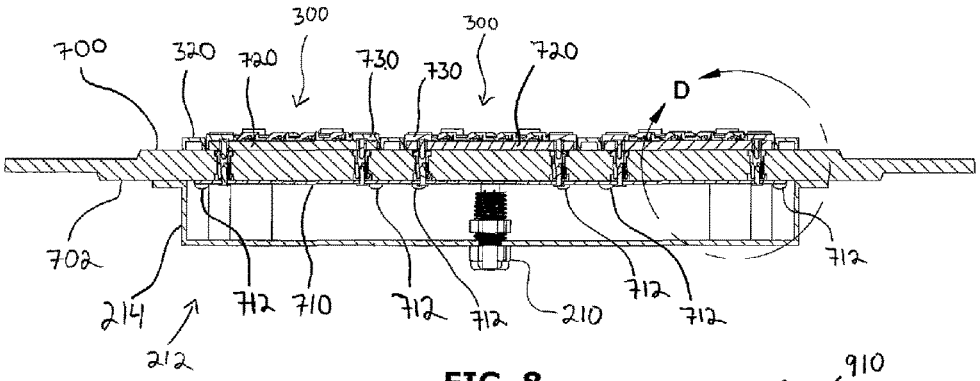
FIG. 8 is a cross-sectional side view of the LED engine system along section line C-C in FIG. 6.
Figure 9:
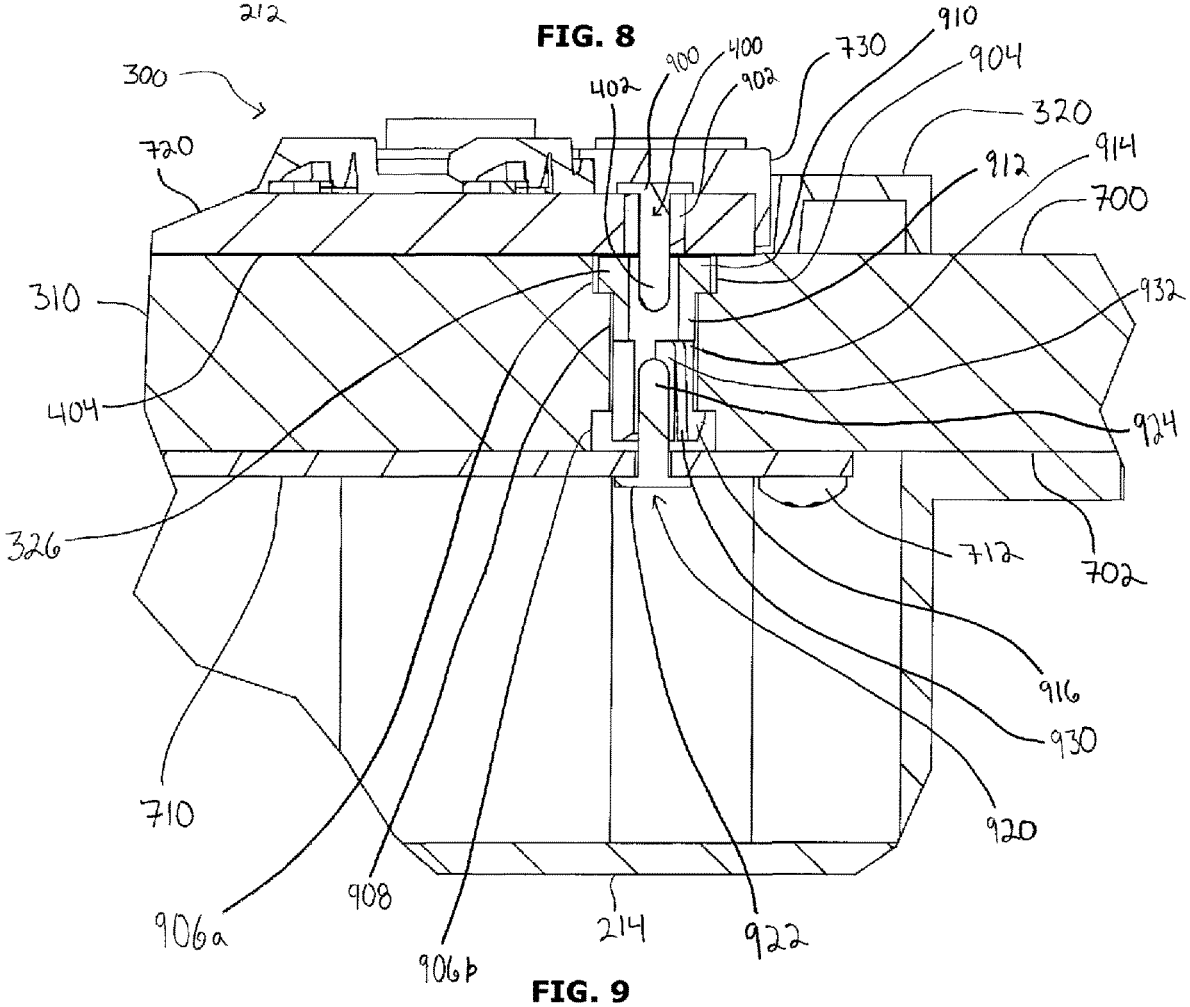
FIG. 9 is a detailed view of a portion of the LED engine system identified as Detail D in FIG. 8.

FIGS. 6-9 exemplify how the various components of the LED engine system 112 may be assembled. In particular, FIG. 6 is a top view of the LED engine system 112, according to one or more embodiments of the present disclosure. In the illustrated example, the LED engine system 112 includes five (5) of the modules 300 installed or mounted on a front face or surface 700 at the front side 304 of the power plate assembly 302. FIG. 7 is a cross-sectional side view of the LED engine system along section line A-A in FIG. 6, whereas FIG. 8 is a cross-sectional side view of the LED engine system along section line C-C in FIG. 6. In addition, FIG. 9 is a detailed view of a portion of the LED engine system 112 identified as Detail D in FIG. 8. As shown, the cover 214 may be installed or mounted on a rear face or surface 702 at the rear side 212 of the power plate assembly 302.

The LED engine system 112 includes a power distribution sub-system that receives power from the external power source via the input (or electrical coupling) 210 and distributes power to each of the modules 300. In the illustrated example, the power distribution sub-system of the LED engine system 112 is a power distribution circuit or a power circuit board 710. Here, the power circuit board 710 is mounted on the rear face 702 of the plate 310 and coupled to the input 210. The power circuit board 710 may be mounted to the plate 310 via a variety of securing means. For example, the power circuit board 710 may be adhered to the plate 310 with an adhesive substance and/or mechanical fasteners may be utilized, etc. In the illustrated example, a plurality of fasteners 712 are utilized to fasten the power circuit board 710 to the rear face 702 of the plate 310.

The power circuit board 710 may also include circuit traces (see FIGS. 12 and 13B) configured to supply power and current to the modules 300. The circuit traces of the power circuit board 710 may be arranged into discrete parallel circuits, with each such parallel circuit being utilized to drive one of the modules 300. Thus, the power circuit board 710 may divide the power and current that it receives from the LED driver 204 into separate circuits that are each configured to drive one of the modules 300. In some examples, the power circuit board 710 is a printed circuit board ("PCB") comprising printed circuit traces that define a plurality of separate parallel circuits, with each such separate parallel circuit corresponding with one of the mounting locations 324 on the front face 700 of the plate 310, such that each of the modules 300 are arranged in parallel with each other. However, other configurations of circuit traces may be utilized for the power circuit board 710. In one example, the power circuit board 710 is an aluminum backed metal PCB; however, other types of PCBs may be utilized, for example, metal PCBs utilizing surface mount technology. The power circuit board 710 is further described with reference to FIGS. 12 and 13A-13B.

In addition, each of the modules 300 includes a module circuit board 720 provided on the front face 700 of the plate 310. The module circuit board 720 includes circuit traces connected to the module power pins 400 of the module 300 and a plurality of LED emitters (obscured from view) arranged on the circuit traces (see FIGS. 14 and 15A-15D). Thus, electricity supplied to the module 300 flows into the first of the pair of module power pins 400, flows through the circuit traces of the module circuit board 720, thereby illuminating the LED emitters arranged thereon, and then flows out of the second of the pair of module power pins 400. In some examples, the module circuit board 720 of one or more of the modules 300 is a PCB comprising printed circuit traces that define a combination of series and parallel circuits, such that the series of LED emitters of the module 300 are arranged in parallel with each other. However, other configurations of circuit traces may be utilized for the module circuit board 720. In one example, the module circuit board 720 is an aluminum backed metal PCB; however, other types of PCBs may be utilized, for example, metal PCBs utilizing surface mount technology. The module circuit board 720 is further described with reference to FIGS. 14 and 15A-15D.

In addition, various current and voltage controlling and limiting components or devices may be included in the power circuit board 710 and/or the module circuit boards 720 to regulate the maximum power and/or current flowing through the traces of the power circuit board 710 and/or the module circuit board 720. These various current and voltage controlling and limiting components or devices may be utilized to prevent application of excessive power and/or current to the module 300. For example, the power circuit board 710 may be configured to prevent application of excessive power to any of the module circuit boards 720, which may otherwise occur in this example when less than five (5) of the modules 300 are mounted on the power plate assembly 302. It will be appreciated, however, that the LED engine system 112 may be provided to accommodate more or less than five (5) total modules, and that the power circuit board 710 is configured to prevent application of excessive power and/or current to any one of the modules 300 regardless of how many of the modules 300 are physically present on the power plate assembly 302 at any given time. Thus, the power circuit board 710 may enable the modules 300 to operate efficiently and at a desired luminous flux output regardless of how many of the modules 300 are mounted on the power plate assembly 302 of the LED engine system 112. The power circuit board 710 and the module circuit board 720 are further exemplified and described with regard to FIGS. 12, 13A-13B and FIGS. 14, 15A-15D, respectively.

Also illustrated, each of the modules 300 includes a module housing 730 for sealing the module 300. As shown, the module housing 730 encapsulates the module circuit board 720 associated therewith, thereby protecting the module circuit board 720 and other internal components of the module 300 against the ingress of moisture, dust, debris, and other contaminants or elements. The module housing 730 may be a molded plastic component, but other materials and processes may be utilized to manufacture or form the module housing 730. For example, the module housing 730 may be made from various high temperature plastics, or made from various fiber/resin based composites, including without limitation fiberglass or carbon-fiber. In one example, the module housing 730 is a molded thermoset frame. Thus, various material may be utilized to manufacture the module housing 730, including those utilized to manufacture the frame 320 and, in one example, the module housing 730 is made from PA512 Injection Molded Polyamide Nylon. The module housing 730 effectively seals the module 300 as a unitary component. Also, the module housing 730 may incorporate a geometry that allows the module 300 to be aligned or oriented on the power plate assembly 302 as mentioned above and, therefore, the module housing 730 may include geometries that correspond with the geometries of the mounting locations 324 as defined by the windows or openings of the frame 320. In addition, the module housing 730 may be configured to allow attachment of the module 300 to the power plate assembly 302 via the springs 340, as described above, and the module housing 730 may also be configured to permit removal of the module 300 from the power plate assembly 302 without use of additional tooling. Thus, the module housing 730 may include geometries that permit the springs 340 to retain the module 300, but which also permit disengagement of the springs 340 such that the module 300 may be removed from the power plate assembly 302. Moreover, a thermally conductive member may be provided. As more fully described below, a thermally conductive member may be arranged between the module circuit board 720 and the front face 700 of the plate 310 to maintain thermal efficiency, by providing low thermal resistance between the module 300 and the plate 310 and by inhibiting creation of thermal insulators there-between.

With reference to FIGS. 8-9, the manner in which electricity flows between the plate circuit board 710 and the module circuit board 720 is described. As illustrated, each of the module power pins 400 is provided within a recess of the module circuit board 720 associated therewith, and each of the module power pins 400 includes a pin head 900 configured to make contact with traces arranged on the module circuit board 720. Each of the module power pins 400 includes a body portion extending from the pin head 900, through the module circuit board 900. As mentioned, the module power pins 400 may be insulated and, in the illustrated example, insulated sleeves 902 are arranged on the module power pins 400 within the recesses of the module circuit board 720. Also, the conductive tip 402 of each of the module power pins 400 extends through the insulated sleeve 902 associated therewith and outward from the bottom surface 404 of the module 300. In this manner, the conductive tip 402 is receivable within the electrical coupling 326 arranged within a coupling recess 904 formed in the plate 310, with the conductive tip 402 contacting a conductive surface of the electrical coupling 326.

As illustrated, the coupling recesses 904 extend through the plate 310, from the front face 700 to the rear face 702. The coupling recesses 904 may each include a front annular portion 906*a* proximate to the front face 700, a rear annular portion 906*b* proximate to the rear face 702, and a central bore portion 908 extending between the front annular portion 906*a* and the rear annular portion 906*b*. Here, the front annular portion 906*a* and the rear annular portion 906*b* have larger diameters than the central bore portion 908.

As described herein, the electrical couplings 326 are assemblies that extend through the plate 310, from the front face 700 to the rear face 702, so as to create an electrically conductive path to interconnect the plate circuit board 710 and the module circuit boards 720 through the plate 310. In the illustrated example, the electrical couplings 326 each include an outer sleeve body having an annular head 910, a central portion 912 extending from the annular head 910, and one or more legs 914 extending from the central portion 912. The electrical couplings 326 are retained in the coupling recesses 904, with the annular head 910 configured to be received in the front annular portions 906*a* of the coupling recesses 904, with the central portion 912 configured to be received within the central bore portion 908 of the coupling recesses 904, and with the one or more legs 914 of the electrical couplings 326 configured to extend into the rear annular portion 906*b* of the coupling recesses 904 and lock or secure the electrical couplings 326 such that the annular head 910 is retained in the front annular portion 906*a* of the coupling recesses 904. For example, the one or more legs 914 of the electrical couplings 326 are configured with a snap-fit design including but not limited to annular snap-fit designs, cantilever snap-fit designs, torsional snap-fit designs, etc. Here, the one or more legs 914 of the electrical couplings 326 include a prong or cantilever 916 that deflects inward when traveling through the central bore portion 908 of the coupling recesses 904, and deflects outward upon entering the rear annular portion 906*b* of the coupling recesses 904 to thereby secure the electrical couplings 326 within the coupling recesses 904.

Thus, after installing the electrical coupling 326 into one of the coupling recesses 904 as illustrated, the annular head 910 is retained in the front annular portion 906*a* of the coupling recess 904 and the prong(s) 916 of the leg(s) 914 are snapped into the rear annular portion 906*b* of the coupling recesses 904, with the central portion 912 and at least a portion of the leg(s) 914 of the electrical couplings 326 extending through the central bore portion 908 of the coupling recesses 904.

Also illustrated in FIG. 9, a plurality of power pins 920 associated with the plate circuit board 710 are be provided. The power pins 920 are PCB pins configured to provide an electrically conductive path from the plate circuit board 710 to the electrical couplings 326, which in turn may be electrically coupled to the module circuit boards 720 via module power pins 400. The plate circuit board 710 may include various numbers of the power pins 920, for example, depending on the maximum number of modules 300 utilizable on the power plate assembly 302. Thus, the number of power pins 920 utilized may depend on the number of coupling recesses 904 and electric couplings 326 provided on the plate 310. In the illustrated example, each of the coupling recesses 904 is associated with one of the electric couplings 326, and each of the electric couplings 326 is associated with one of the power pins 920. As illustrated, each of the power pins 920 includes a conductive head 922 configured to contact an electrical trace (not illustrated) on the plate circuit board 710, and a conductive tip 924 extending from the conductive head 922. The conductive tip 924 of each of the power pins 920 is configured to engage a conductive surface of the electrical coupling 326 associated therewith, so as to establish a conductive path between the plate circuit board 710 to the electrical couplings 326.

The electrical couplings 326 are configured as pin receptacles for receiving the power pins 920 and the module power pins 400 (collectively, the power pins 920,400) associated with the plate circuit board 710 and the module circuit boards 720, respectively. Thus, the electrical couplings 326 include a conductive surface that is configured to be contacted by the power pins 920,400 and/or the conductive tips 924,402 thereof. This conductive surface may be provided on a bore defined within the electrical coupling 326, for example, on a bore defined by the annular head 910, the central portion 912, and the leg(s) 914 of the electrical coupling 326.

In some examples, the electrical couplings 326 further include an electrical contact sub-assembly arranged within the bore of the electrical couplings 326 to create the conductive surface through the electrical coupling 326. In these examples, the electrical contact sub-assembly may include a contact tube (obscured from view) made of electrically conductive material and dimensioned in correspondence with the depth dimension of the coupling recess 904 so as to extend substantially from the front face 700 of the plate to the rear face 702 of the plate. In these examples, the electrical contact sub-assembly may also include a front contact (obscured from view) and/or a rear contact 930. The front contact and the rear contact 930 are made of electrically conductive material and arranged within a front end and a rear end of the contact tube such that they are positioned within the front annular portion 906*a* and the rear annular portion 906*b* of the coupling recess 904, respectively. The front contact and the rear contact 930 each include a ring portion (obscured from view) provided on an interior bore surface of the contact tube, thereby creating a conductive path (between it and the contact tube) and each include one or more flared contact pads 932. The flared contact pads 932 extend from the ring portion, inward into a bore of the contact tube, and are configured to receive and engage an electrical contact or power pin (e.g., the module power pin 400 and/or a power pin 920). Also, the flared contact pads 932 may be angled so as to receive the conductive tip (e.g., the conductive tips 402,924 of the power pin 400,920) without interference or "snagging" such that the power pin 400,920 may be insertable and removable from the electrical contact sub-assembly without causing damage.

Thus, the electrical couplings 326 are receptacles for the power pins 400,920 that help establish an electrically conductive path through the plate 310, between the front face 700 and the rear face 702 of the plate 310, for interconnecting the plate circuit board 710 and the module circuit boards 720 that are mounted on the rear face 702 and the front face 700, respectively.

Figure 10:
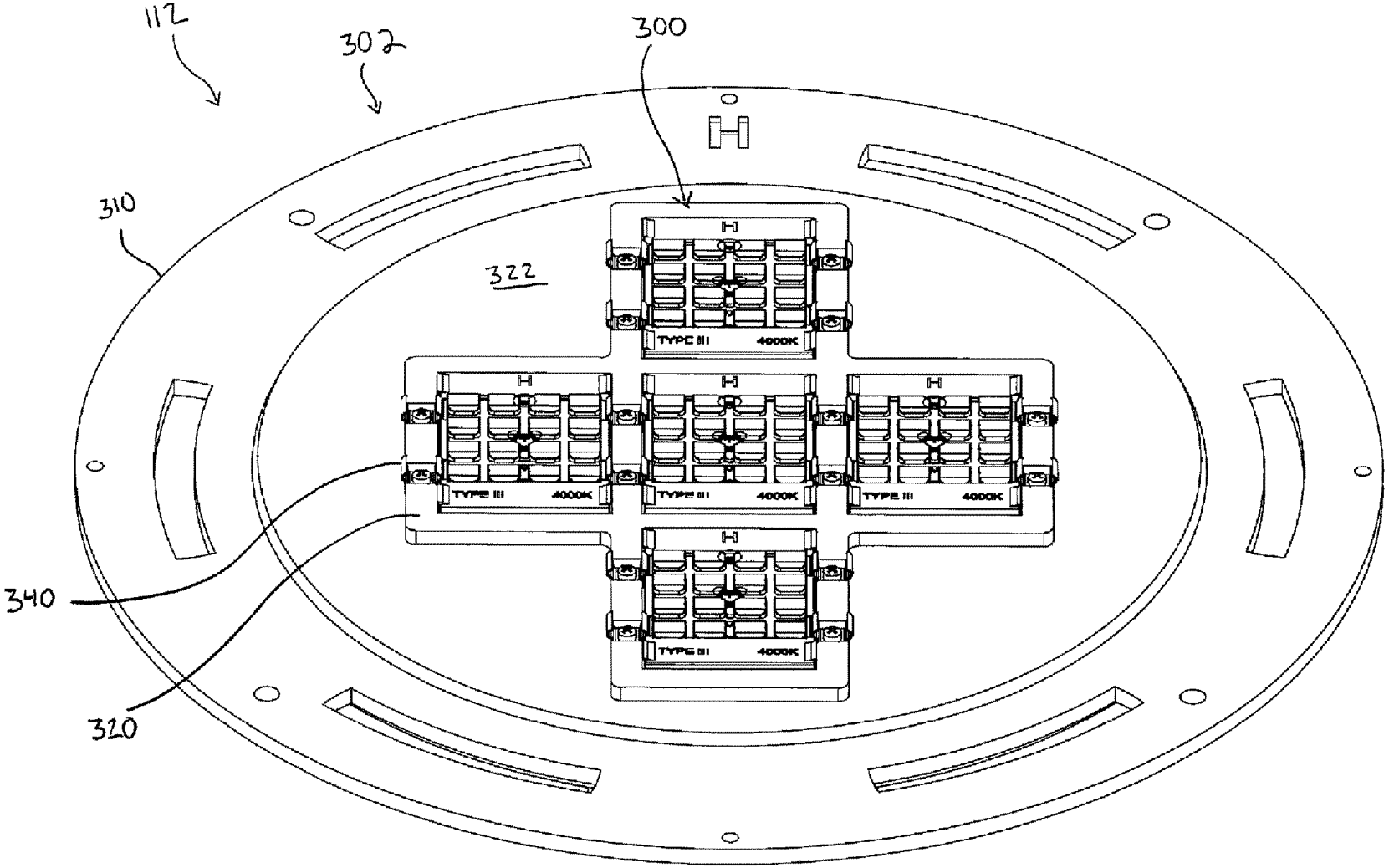
FIG. 10 is a perspective front view of the LED engine system having a plurality of LED modules mounted thereon.
Figure 11:
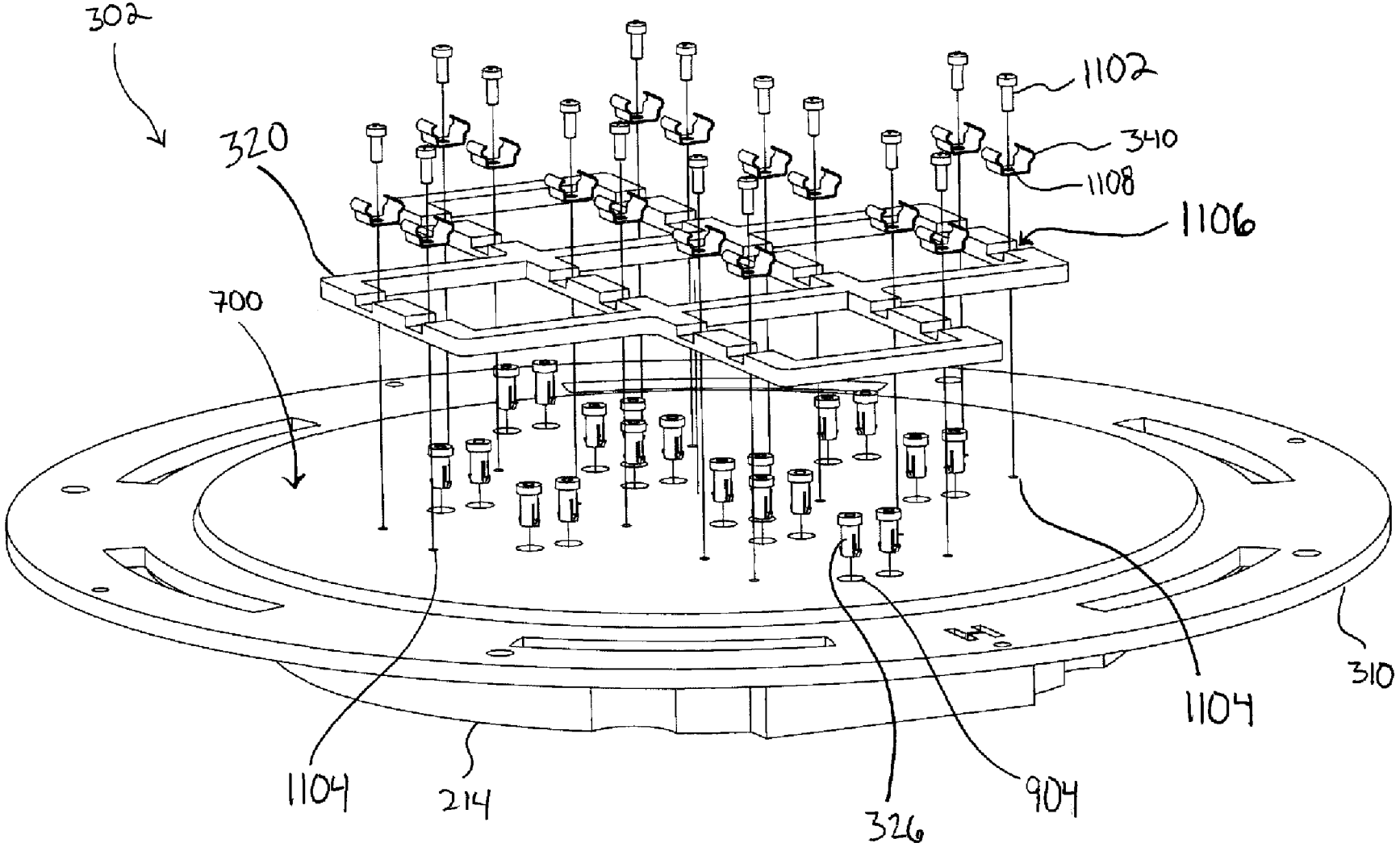
FIG. 11 is an exploded upper perspective view of the LED engine system of FIG. 10.
Figure 12:
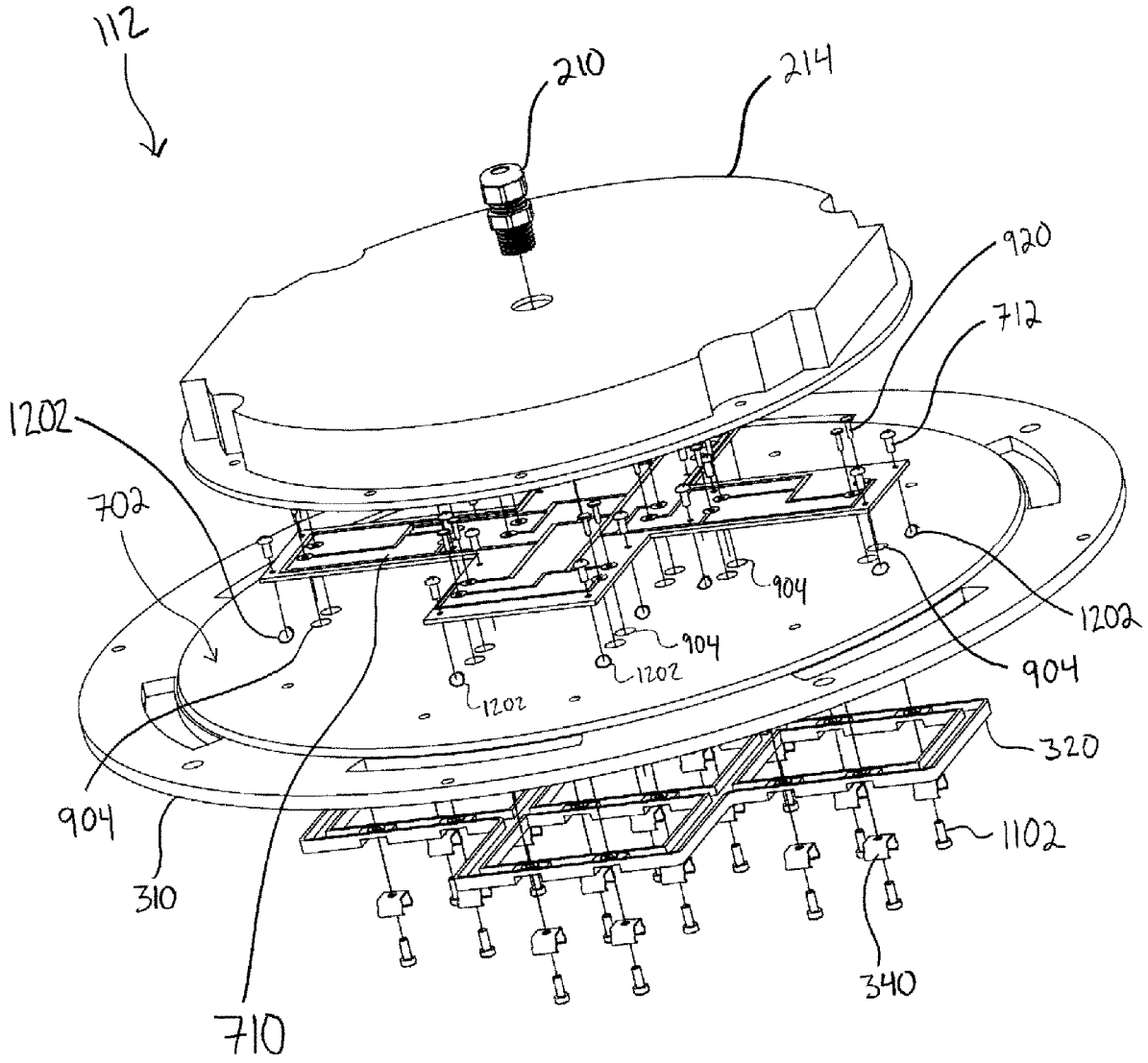
FIG. 12 is an exploded lower perspective view of the LED engine system of FIG. 10.

FIGS. 10-12 exemplify how electricity may be transmitted through the LED engine system 112, according to one or more embodiments. FIG. 10 is a perspective front view of the LED engine system 112 having a plurality of LED modules 300 removably mounted thereon. As previously mentioned, each of the LED modules 300 includes a circuit board (i.e., the module circuit board 720) and a pair of contact pins (i.e., the pair of module power pins 400) extending therefrom. The LED engine system 112 drives the LED modules 300 when the LED modules 300 are mounted at the mounting location 324 on the power plate assembly 302, such that the pair of module power pins 400 engage the contact surface of the electrical couplings 326, thereby allowing the power circuit board 710 to distribute electricity to the LED modules 300. FIGS. 11-12 are exploded views of the LED engine system 112 of FIG. 10 where the LED modules 300 have been removed or uninstalled therefrom. In particular, FIGS. 11-12 illustrate an exemplary construction of the power plate assembly 302 and an example of how the power circuit board 710 may be connected to the power plate assembly 302 to permit energization of the electrical couplings 326.

FIG. 11 is an exploded upper perspective view of the LED engine system of FIG. 10. In particular, FIG. 11 illustrates the various components of the power plate assembly 302 when unassembled. Thus, FIG. 11 illustrates the frame 320 unassembled from the front face 700 of the plate 310. In the illustrated example, the frame 320 is secured to the plate 310 via a plurality of fasteners (e.g., screws) 1102 that extend into corresponding holes 1104 into the mounting surface 322 of the plate 310; however, other means may be utilized to secure the frame 320 to the plate 310. Also, the frame 320 includes a plurality of grooves 1106 configured to receive the springs 340. Here, an opening 1108 extends through the spring 340 and a corresponding opening (obscured from view) extends through the groove 1104 associated therewith, such that the fasteners 1102 may be inserted through the springs 340 and the grooves 1104 in the frame 320, into their corresponding holes 1104 to fasten the frame 320 to the plate 310. In other examples, however, the frame 320 and/or the springs 340 may be differently secured. FIG. 11 also illustrates the plurality of electrical couplings 326 unassembled from their respective coupling recesses 904 formed in the mounting surface 322 of the plate 310.

FIG. 12 is an exploded lower perspective view of the LED engine system 112 of FIG. 10. In particular, FIG. 12 illustrates the cover 214 unassembled from the rear face 702 of the plate 310 so as to expose the power circuit board 710 and the power pins 920 associated therewith. As previously mentioned, the power circuit board 710 is secured to the plate 310 via the fasteners 712. Here, the power circuit board 710 is also illustrated unassembled from the plate 310 so as to expose a plurality of corresponding holes 1202 configured to receive the fasteners 712. Also illustrated are the plurality of coupling recesses 904 that extend through the plate 310, from the rear face 702 to the front face 700. As mentioned, the coupling recesses 904 are configured to receive the electrical couplings 326 having the contact surface, as detailed above; and, when the power circuit board 710 is fastened on the plate 310, the power pins 920 extend into the coupling recesses 904 to engage and contact the conductive surface within the electrical couplings 326.

Figure 13A:
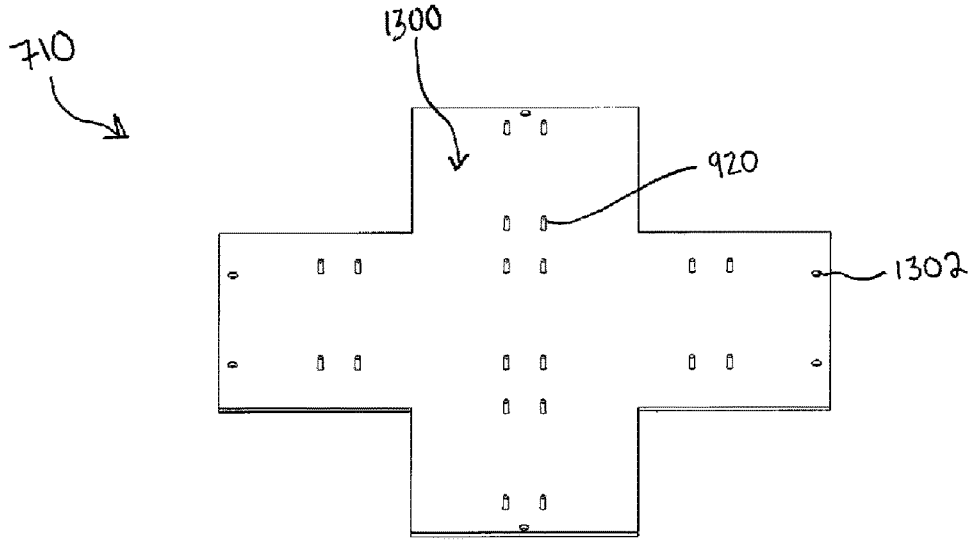
FIG. 13A is a top perspective view of an exemplary power circuit board utilizable in an LED engine system having a plurality of interchangeable LED modules.
Figure 13B:
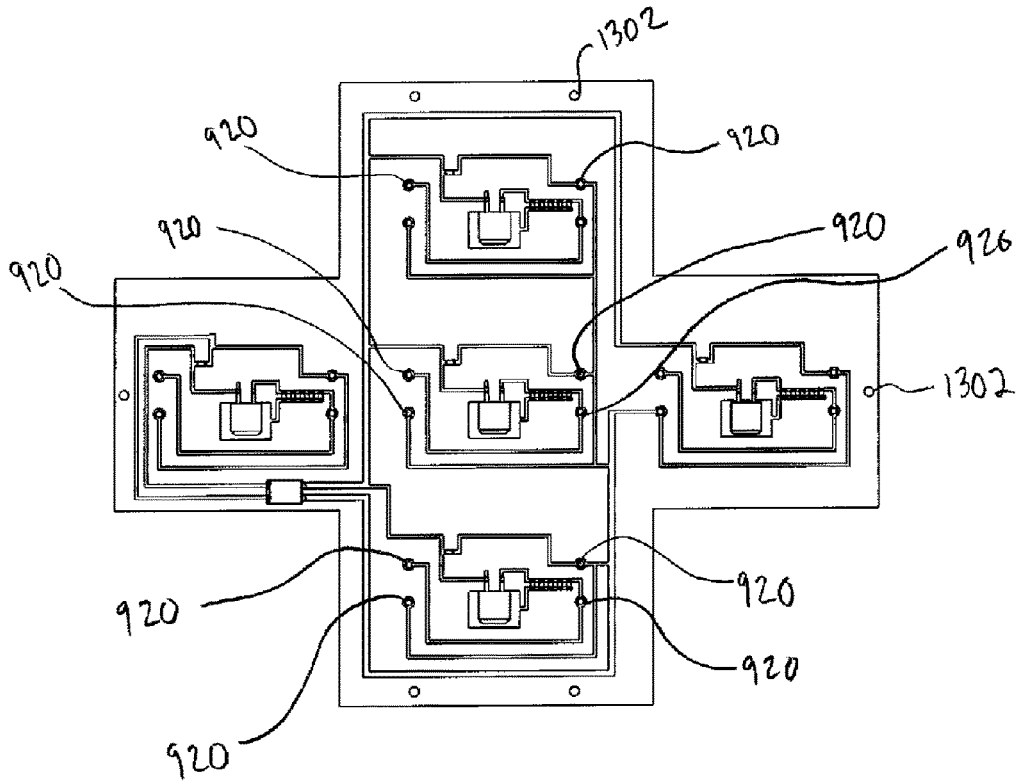
FIG. 13B is a bottom view of the power circuit board of FIG. 13A.

The power circuit board 710 is further described with reference to FIGS. 13A-13B. FIG. 13A is a top perspective view of an exemplary power circuit board 710 utilizable in the LED engine system 112 having a plurality of interchangeable LED modules 300. FIG. 13B is a bottom view of the power circuit board 710 of FIG. 13A. FIG. 13A illustrates an interior surface 1300 of the power circuit board 710, from which the plurality of power pins 920 extend or protrude when the interior surface 1300 is mounted over the rear face 702 of the plate 310 as detailed above. FIG. 13B illustrates an opposing side of the power circuit board 710 on which the power pins 920 are mounted and having a plurality of circuitry components (e.g., traces, capacitors, resistors, regulators, etc.) configured to distribute electricity to the various LED modules 300 as detailed above. Here, the power circuit board 710 includes five (5) different parallel sub-circuits, each corresponding with one of the mounting locations 324 for receiving one of the LED modules 300. Also, each of the five (5) different parallel sub-circuits include two (2) pairs of the power pins 920, with the first pair of the power pins 920 being in electrical communication with the LED module 300 when the LED module 300 is in a first position, and the second pair of the power pins 920 being in electrical communication with the LED module 300 when the LED module 300 is in a second position. Thus, not only does the LED engine system 112 allow end-users to select the number of LED modules 300 to be mounted/utilized without affecting the luminous flux output of the remaining LED modules 300, but the LED engine system 112 also allows end-users to modify how one or more of the LED modules 300 are mounted on the plate assembly 302 so as to customize or vary the optical light distribution pattern. For example, as mentioned, the LED module 300 may be mounted in a first position (i.e., when the reference plane 332 of the LED module 330 is parallel or at zero degrees (0°) relative to reference plane 330) or in a second position (i.e., when the reference plane 332 of the LED module 330 is rotated 180° relative to the reference plane 330).

In other examples, the LED modules 300 and the power plate assembly 302 are configured to permit selective mounting of the LED modules 300 at other positions. Thus, the LED engine system 112 may be provided to permit mounting of one or more of the LED modules 300 when the reference plane 332 is oriented at other angles relative to reference plane 300. For example, the LED engine system 112 may instead be configured such that the LED module 300 may be mounted in a first position where the reference planes 330 and 332 are oriented at ninety degrees (90°) relative to each other or in a second position where the reference planes 330 and 332 are oriented at two hundred and seventy degrees (270°) relative to each other. In even other examples, the LED engine system 112 is configured to permit mounting of one or more of the LED modules 300 in additional positions (e.g., a third position, a fourth position, etc.), in addition to or in lieu of any of the foregoing first and second positions. Thus, the LED engine system 112 may be configured to permit mounting of the LED modules 300 in three (3) or more positions. In such embodiments, the LED modules 300 and the power plate assembly 302 may be configured with additional corresponding pairs of pins and electrical couplings to complete an electrical circuit when the LED module 300 is so positioned in any of such three (3) or more positions. For example, the LED engine system 112 may be configured such that the LED module 300 may be mounted: (i) in a first position where the reference plane 332 of the LED module 330 is parallel or at zero degrees (0°) relative to reference plane 330; (ii) in a second position where the reference planes 330 and 332 are oriented at ninety degrees (90°) relative to each other, (iii) in a third position where the reference plane 332 of the LED module 330 is rotated 180° relative to the reference plane 330, (iv) or in a fourth position where the reference planes 330 and 332 are oriented at two hundred and seventy degrees (270°) relative to each other. In even other examples, the LED module 300 may be mounted at even other positions in addition to or in lieu of the foregoing positions.

Figure 14:
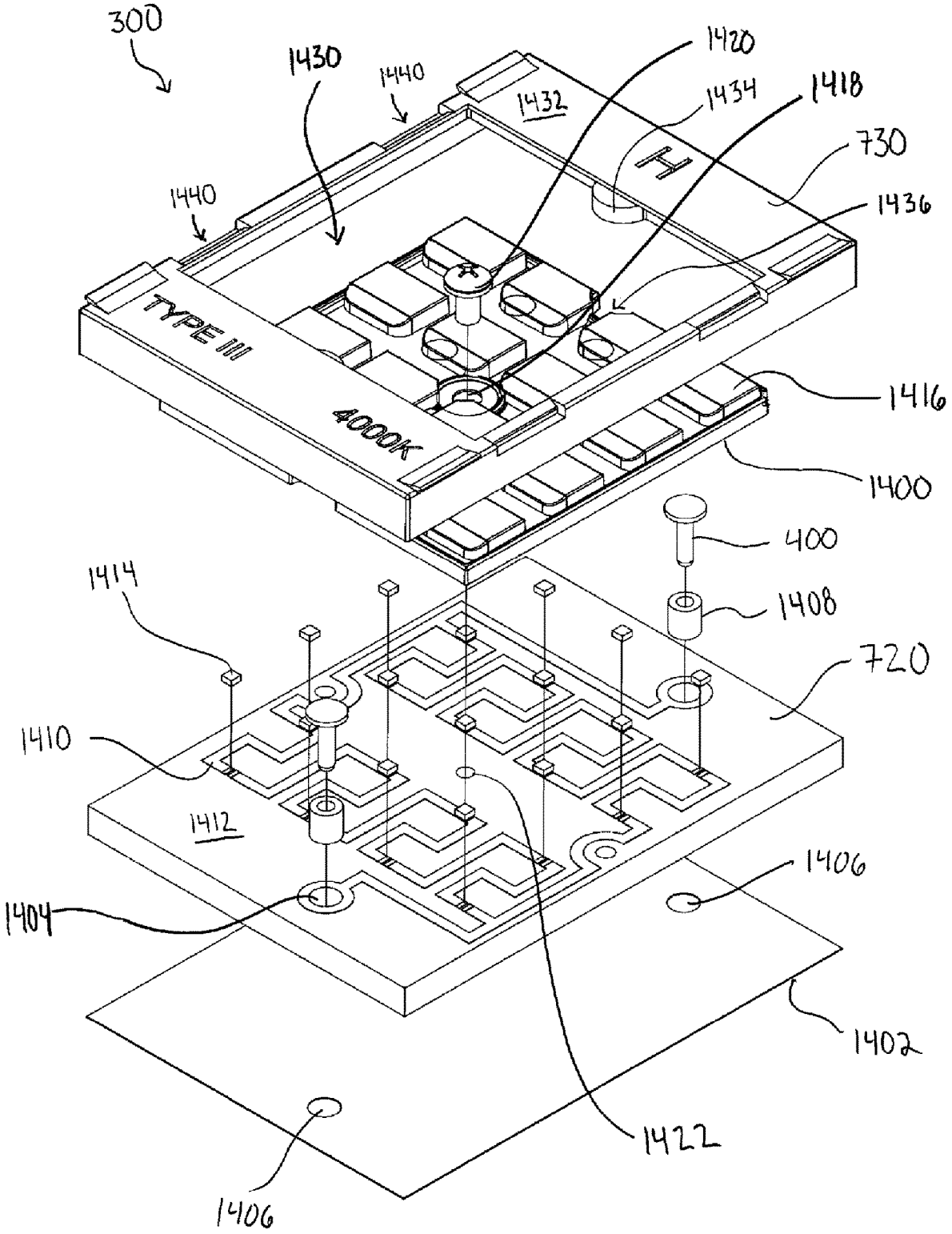
FIG. 14 is an exploded view of an interchangeable LED module utilizable with the LED engine systems described herein.

FIG. 14 is an exploded view of an interchangeable LED module 300, according to one or more embodiments of the present disclosure. As mentioned, the LED module 300 includes the module housing 730 and the module circuit board 720. In addition, the LED module 300 includes an optic lens 1400 and a thermally conductive transfer pad 1402. The thermally conductive transfer pad 1402 may be mounted on a bottom surface of the module circuit board 720 (or on the bottom surface of the LED module 300) so as to contact the front face 700 of the plate 310 and thereby interpose the LED module 300 and the plate 310. The thermally conductive transfer pad 1402, when compressed between the LED module 300 and the plate 310, may help inhibit or prevent formation of air gaps between the LED module 300 and the plate 310 that would otherwise act as thermal insulators. The thermally conductive transfer pad 1402 may be made from various thermally conductive materials and, in one example, is a ceramic filled Silicon sheet.

In the illustrated example, the module circuit board 720 includes a pair of openings 1404 at opposing ends configured to receive the module power pins 400. Also, the thermally conductive transfer pad 1402 includes corresponding holes 1406 that align with the openings 1404 when the thermally conductive transfer pad 1402 is mounted on the bottom surface of the module circuit board 720, such that the power pins 400 may also extend through the holes 1406 in the thermally conductive transfer pad 1402. In addition, an insulator sleeve 1408 is provided in each of the openings 1404 of the module circuit board 720, and the insulator sleeve 1408 includes a bore for receiving the module power pins 400. Thus, when assembled, the insulator sleeves 1408 are arranged in the openings 1404 of the module circuit board 720, and the module power pins 400 extend through bores in the insulator sleeves 1408, thereby inhibiting contact between an internal thickness of the module circuit board 720 and the module power pins 400. Also, the insulator sleeve 1408 may extend into the holes 1406 in the thermally conductive transfer pad 1402; however, in other examples the insulator sleeve 1408 may be sized in accordance with the thickness of the module circuit board 720 so as to not extend into the holes 1406 in the thermally conductive transfer pad 1402, and in such examples, the holes 1406 may be sized in accordance with a diameter of the module power pins 400 so as to inhibit formation of any air gaps.

As illustrated, the module circuit board 720 includes a series of electrical traces 1410 arranged on a top surface 1412 of the module circuit board 720 and a plurality of LED emitters 1414 arranged at various locations of the electrical traces 1410. The LED emitters 1414 may emit various wavelengths of light, including white light, monochromatic light, as well as infra-red or ultraviolet. Also, each of the LED emitters 1414 in the LED module 300 may be of the same type, or one or more of the LED emitters 1414 may be of one or more different types, for example, to provide a different CCT level. As will be appreciated, the electrical traces 1410 deliver electricity to the LED emitters 1414 such that they may generate light. In the illustrated example, the LED emitters 1414 are arranged on the module circuit board 720 in a four by four (4×4) array or pattern; however, different arrangements or organizations of the LED emitters 1414 may be provided.

The optic lens 1400 is arranged on a top surface 1412 and covers the LED emitters 1414. In one example, the optic lens 1400 is made from Polymethyl Methacrylate ("PMMA"). However, the optic lens 1400 may be made from various other materials, including liquid silicone rubber or other suitable optic materials as known in the art. As shown, the optic lens 1400 includes a plurality of secondary lenses 1416, with each of the secondary lenses 1416 arranged to correspond with one of the LED emitters 1414. Thus, in this example, the secondary lenses 1416 are also arranged in a four by four (4×4) array or pattern so as to correspond with the LED emitters 1414. However, the arrangement and organization of the secondary lenses 1416 may vary depending on the arrangement or organization of the LED emitters 1414. Also, the optic lens 1400 includes a mounting hole 1418 for receiving a fastener (e.g., a screw 1420). The screw 1420 may be inserted through the mounting hole 1418 in the optic lens 1400 and into a corresponding mounting hole 1422 in the module circuit board 720, to thereby secure the optic lens 1400 to the module circuit board 720.

The LED module 300 is sealed against ingress of moisture and debris via the module housing 730. When assembled, the module housing 730 encapsulates the module circuit board 720 and the optic lens 1400, thereby sealing the LED module 300 as a single sealed unit. The module housing 730 includes a window 1430 for receiving and exposing the optic lens 1400 so that the LED emitters 1414 thereunder may distribute light outward from the LED module 300, unobstructed by the module housing 730. When the module housing 730 is assembled over the optic lens 1400, the secondary lenses 1416 may extend upward beyond a face 1432 of the module housing 730; however, in other examples the secondary lenses 1416 may be flush with or extend towards but below the face 1432 of the module housing 730. In some examples, the module housing 730 includes at least one abutment 1434 configured to retain, or assist in retaining, the secondary lenses 1416 beneath the module housing 730 and/or to inhibit the secondary lenses 1416 from being pulled out from the window 1430 thereof. In such examples, the secondary lenses 1416 may include a corresponding recess 1436 configured to receive the abutment 1434. Also in the illustrated example, the module housing 730 includes a plurality of indents 1440 provided about the periphery of the module housing 730 that are configured to receive a flange (not illustrated) of the springs 340. Accordingly, the LED modules 300 may be retained to the power plate assembly 302 via the flanges of the springs 340 snap-fitting into the indents 1440.

The module circuit board 720 is further illustrated and described with reference to FIGS. 15A-15D.

In each of these figures, the module circuit board 720 is oriented along a central axis 1500 with the pair of openings 1404 oriented on one side of the central axis 1500. Thus, the module power pins 400 will similarly be oriented on one side of the central axis 1500 when assembled. In this manner, the module power pins 400 are asymmetrically arranged in the LED module 300. Accordingly, the LED modules 300 illustrated in FIGS. 15A-15D may be considered to be in a first position where the module power pins 400 to be associated therewith are to the left hand side of the central axis 1500, and such module power pins 400 would be received within a first set of electrical couplings 326 similarly disposed on the left hand side of a projection of the central axis 1500 on the mounting location 324; however, as described herein, the LED modules 300 illustrated in FIGS. 15A-15D may be rotated 180° into a second position where the module power pins 400 to be associated therewith are to the right hand side of the central axis 1500, and such module power pins 400 would be received within a second set of electrical couplings 326 similarly disposed on the right hand side of a projection of the central axis 1500 on the mounting location 324.

Figure 15A:
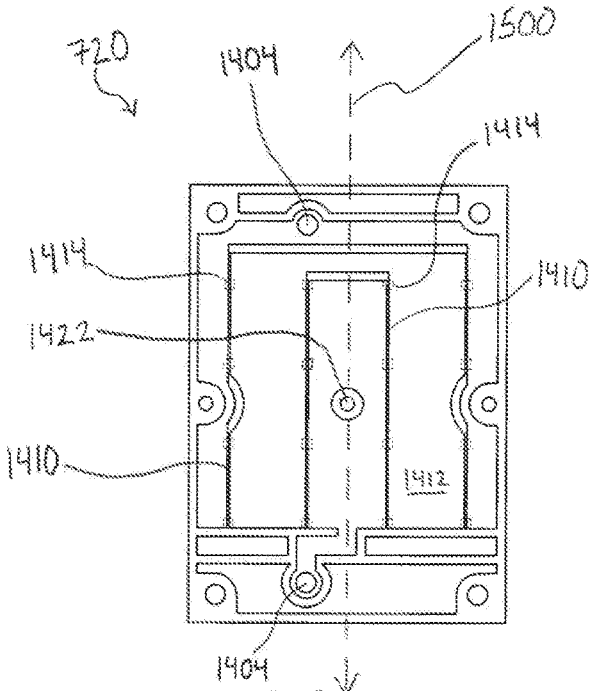
FIG. 15A is a top view of an exemplary LED module circuit board utilizable with the interchangeable LED module of FIG. 14. [
Figure 15B:
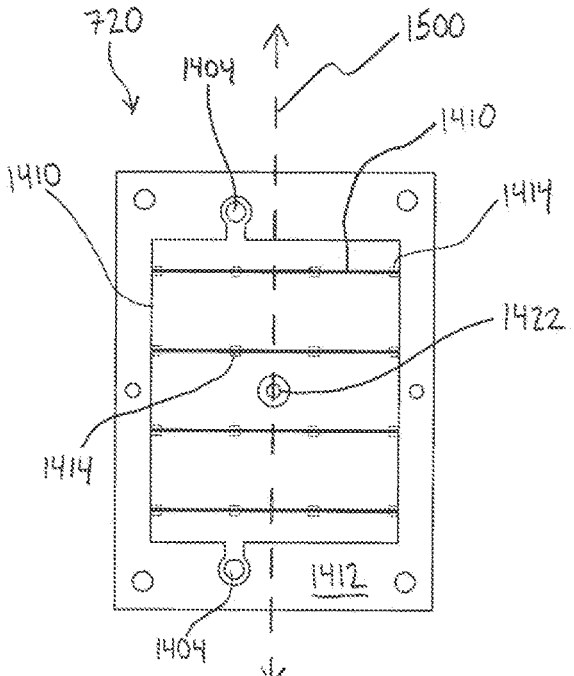
FIG. 15B is a top view of another exemplary LED module circuit board utilizable with the interchangeable LED module of FIG. 14.
Figure 15C:
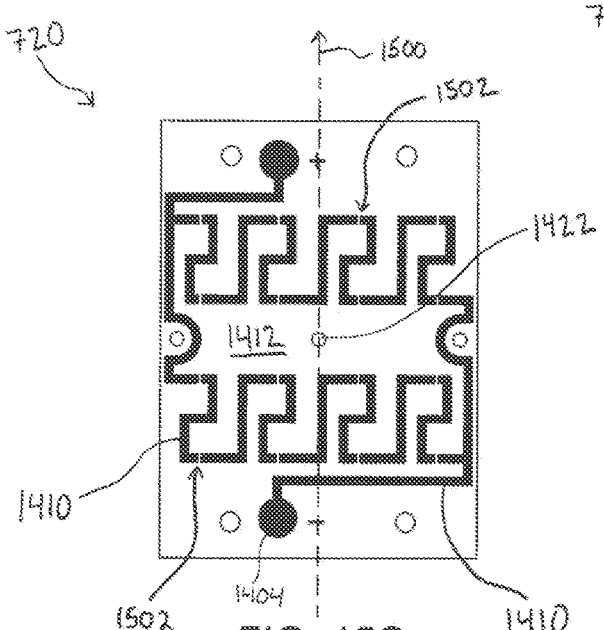
FIG. 15C is a top view of another exemplary LED module circuit board utilizable with the interchangeable LED module of FIG. 14.
Figure 15D:
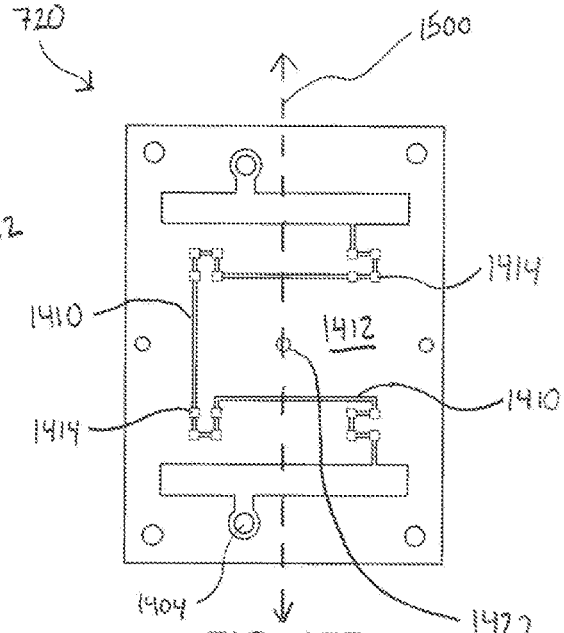
FIG. 15D is a top view of another exemplary LED module circuit board utilizable with the interchangeable LED module of FIG. 14.

FIG. 15C is a top view of the module circuit board 720 of FIG. 14. In this particular illustration, the LED emitters 1414 have been removed to illustrate LED locations 1502 arranged within the electrical traces 1410 to receive the LED emitters 1414. Also, FIGS. 15A-15B are top views of alternate exemplary module circuit boards 720 that may be incorporated into the interchangeable LED module 300 of FIG. 14.

While each of the circuit boards 720 of FIGS. 15A-15D are illustrated as including a total of sixteen (16) of the LED emitters 1414, they may include more or less than sixteen (16) of the LED emitters 1414 without departing from the present disclosure. Also, the LED emitters 1414 provided in any one of the LED modules 300 may all be of the same type or family. In one example, all of the LED emitters 1414 arranged on the circuit board 720, regardless of its configuration, are of the Cree XD16 LED family of LEDs. In other examples, however, one or more of the LED emitters 1414 is of a different type or family of LEDs. Also, the LED emitters 1414 arranged on any one of the circuit boards 720 may have one or more different CCT ratings. For example, a first group of the LED emitters 1414 within the LED module 300 may have a first CCT rating, a second group of the LED emitters 1414 within the LED module 300 may have a second CCT rating, etc.

The traces 1410 of the circuit board 720 may also have various configurations. The circuit board 720 of FIG. 15A includes sixteen (16) LED emitters 1414 mounted on the electrical traces 1410. In this example, the electrical traces 1410 define or are arranged in eight (8) parallel circuits, with each such parallel circuit containing two (2) LED emitters 1414 arranged in series. In. FIG. 15B, the circuit board 720 also includes sixteen (16) LED emitters 1414 mounted on the electrical traces 1410. However, in the example of FIG. 15B, the electrical traces 1410 define or are arranged in four (4) parallel circuits, with each such parallel circuit containing four (4) LED emitters 1414 arranged in series. In FIG. 15C, the circuit board 720 of FIG. 15C is also designed for sixteen (16) LED emitters 1414 and thus includes sixteen (16) LED locations 1502 (each for receiving a corresponding LED emitter 1414) provided within the electrical traces 1410. In this example, the electrical traces 1410 define or are arranged in two (2) parallel circuits, with each such parallel circuit containing eight (8) LED locations 1502 in series. Thus, each of the two (2) parallel circuits in the example of FIG. 15C may include eight (8) LED emitters 1414 arranged in series. Lastly, the circuit board 720 of FIG. 15D also includes sixteen (16) LED emitters 1414 mounted on the electrical traces 1410. In this example, the electrical traces 1410 define or are arranged as a single series circuit, such that the sixteen (16) LED emitters 1414 are arranged in series.

The use of different combinations of parallel circuits and/or series circuits provides a method for controlling the current and voltage levels required by the array of LED emitters 1414 in order to provide the most efficient pairing of driver and LED emitter. When designing the LED system 112 for a particular end-use application, the amount of light required (i.e., lumens) is a design consideration and, therefore, it may be beneficial to provide a high efficacy (lumens per watt), which in turn defines the power requirement (watts). Each emitter draws a set amount of voltage, and the number of emitters may be determined by the amount of light required in the particular end-use application, and the brightness of each emitter is determined by the amount of current provided. To match the limited combinations of forward voltage and forward current found in LED drivers, to the draw of the LED load, the LED emitters may be arranged in the appropriate series\parallel circuit configurations. Thus, in order to optimize output and reliability, the circuit board 720 may include circuit traces 1410 that define various combinations of parallel and/or series circuits similar to or different than as described with reference to FIGS. 15A-15D, and/or with the same or different amount of associated LED emitters 1414 than as previously described.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The terms "proximal" and "distal" are defined herein relative to a mount or pole for luminaire housing or luminaire system having an interface configured to mechanically and electrically couple an LED module to a power source. The term "proximal" refers to the position of an element closer to the mount or the power source and the term "distal" refers to the position of an element further away from the mount or the power source. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An LED engine system, comprising:

a power plate assembly having a plate, a frame secured on a front face of the plate, and a power distribution circuit arranged on a rear face of the plate, wherein the power distribution circuit is configured to distribute electricity to a plurality of mounting locations defined by the frame on the front face of the plate; and one or more LED modules attach within the plurality of mounting locations, wherein the one or more LED modules are configured to be mounted within the mounting locations when oriented in at least two positions.

2. The LED engine system of claim 1, further comprising a driver for supplying power to the power distribution circuit, wherein the driver is configured to maintain constant output voltage from the power distribution circuit regardless of how many of the one or more LED modules are mounted to the power plate assembly.

3. The LED engine system of claim 1, wherein the power distribution circuit includes a plurality of parallel sub-circuits that each correspond with one of the mounting locations.

4. The LED engine system of claim 3, wherein each of the plurality of parallel sub-circuits of the power distribution circuit are arranged on the rear face of the plate at locations associated with one of the mounting locations on the front face of the plate.

5. The LED engine system of claim 3, further comprising a driver for supplying power to the power distribution circuit such that each of the plurality of parallel sub-circuits thereof maintains constant output voltage regardless of whether an associated one of the one or more LED modules has been removed from the mounting location corresponding with the parallel sub-circuit.

6. The LED engine system of claim 1, wherein the power plate assembly further includes a plurality of electrical coupling pairs arranged within the plate and in communication with the power distribution circuit, wherein at least two of the electrical coupling pairs are provided within each of the mounting locations.

7. The LED engine system of claim 6, the one or more LED modules each further comprising a pair of power pins configured to communicate with the electrical coupling pairs.

8. The LED engine system of claim 7, wherein the pair of power pins of each of the one or more LED modules is arranged asymmetric relative to a perpendicular reference plane of the LED module, and wherein each mounting location includes a first pair of electrical couplings and a second pair of electrical couplings that are arranged symmetrical relative to a perpendicular reference plane of the mounting location.

9. The LED engine system of claim 1, wherein the one or more LED modules are mounted within the mounting locations when oriented in a first position or when oriented in a second position, the first position being defined as a position of the LED module where a reference plane of the LED module that is perpendicular of the front face of the plate is parallel to a reference plane of the plate, and the second position being defined as a position of the LED module after the LED module has been rotated 180 degrees from the first position such that the reference plane of the LED module is parallel to the reference plane of the plate.

10. The LED engine system of claim 9, wherein the one or more LED modules each include a pair of power pins arranged asymmetric relative to the reference plane of the LED module.

11. The LED engine system of claim 9, wherein the power plate assembly further includes a plurality of electrical couplings arranged within the plate and in communication with the power distribution circuit, wherein at least two pairs of the electrical couplings are arranged within each of the mounting locations.

12. An LED engine system, comprising:

a power plate assembly having a plate, a frame secured on a front face of the plate, and a power distribution circuit arranged on a rear face of the plate, wherein the power distribution circuit is configured to distribute electricity in parallel to a plurality of mounting locations defined by the frame on the front face of the plate;

a driver for supplying power to the power distribution circuit; and one or more LED modules attach within the plurality of mounting locations, wherein the one or more LED modules are configured to be mounted within the mounting locations when oriented in at least two positions.

13. The LED engine system of claim 12, wherein the power distribution circuit includes a plurality of parallel sub-circuits that each correspond with one of the mounting locations.

14. The LED engine system of claim 13, wherein each of the plurality of parallel sub-circuits of the power distribution circuit are arranged on the rear face of the plate at locations associated with one of the mounting locations on the front face of the plate.

15. The LED engine system of claim 13, wherein the driver is a constant voltage driver configured to maintain constant output voltage of each of the plurality of parallel sub-circuits of the power distribution circuit regardless of whether the plurality of parallel sub-circuits of the power distribution are loaded.

16. The LED engine system of claim 12, wherein the power plate assembly further includes a plurality of electrical coupling pairs arranged within the plate and in communication with the power distribution circuit, wherein at least two of the electrical coupling pairs are provided within each of the mounting locations.

17. The LED engine system of claim 16, the one or more LED modules each further comprising a pair of power pins configured to communicate with the electrical coupling pairs.

18. The LED engine system of claim 17, wherein the pair of power pins of each of the one or more LED modules is arranged asymmetric relative to a perpendicular reference plane of the LED module, and wherein each mounting location includes a first pair of electrical couplings and a second pair of electrical couplings that are arranged symmetrical relative to a perpendicular reference plane of the mounting location.

19. An LED engine system, comprising:

a power plate assembly having a plate, a power distribution circuit arranged on a rear face of the plate and having a plurality of parallel circuits, a plurality of electrical coupling pairs arranged within the plate and in communication with the power distribution circuit, and a frame secured on a front face of the plate and defining a plurality of mounting locations, wherein at least two of the electrical coupling pairs are associated with each of the mounting locations and the power distribution circuit is configured to distribute electricity to the at least two electrical coupling pairs of each mounting location in parallel;

a constant voltage driver for supplying power to the power distribution circuit; and one or more LED modules attach within the plurality of mounting locations, wherein each of the LED modules includes a pair of asymmetrical power pins configured to mate with the electrical coupling pairs when the LED module is oriented in one of at least two positions.

20. The LED engine system of claim 19, wherein the pair of asymmetrical power pins of each of the one or more LED modules are off-set from a perpendicular reference plane of the LED module, and wherein each mounting location includes a first pair of electrical couplings and a second pair of electrical couplings that are arranged symmetrical relative to a perpendicular reference plane of the mounting location.

* * * * *